US005610006A

United States Patent [19]

Yokokawa et al.

[11] Patent Number: 5,610,006

[45] Date of Patent: Mar. 11, 1997

[54] HEAT-DEVELOPABLE PHOTOGRAPHIC MATERIAL

[75] Inventors: Takuya Yokokawa; Tomoyuki Koide, both of Kanagawa, Japan

[73] Assignee: Fuji Photo Film Co., Ltd., Kanagawa, Japan

[21] Appl. No.: 240,220

[22] Filed: May 9, 1994

Related U.S. Application Data

[63] Continuation of Ser. No. 970,157, Nov. 2, 1992.

[30] Foreign Application Priority Data

Nov. 5, 1991 [JP] Japan ..... 3-315219
Apr. 21, 1992 [JP] Japan ..... 4-126629

[51] Int. Cl.$^6$ ..... G03C 1/09

[52] U.S. Cl. ..... 430/604; 430/605; 430/617; 430/619; 430/944

[58] Field of Search ..... 430/604, 605, 430/617, 619, 944

[56] References Cited

U.S. PATENT DOCUMENTS 5,051,344 9/1991 Kuno ..... 430/604
5,064,753 11/1991 Sohei et al. ..... 430/619
5,084,376 1/1992 Suda et al. ..... 430/619
5,132,203 7/1992 Bell et al. ..... 430/604
5,166,044 11/1992 Asami ..... 430/605
5,229,263 7/1993 Yoshida et al. ..... 430/604

FOREIGN PATENT DOCUMENTS 2236542 9/1990 Japan .

OTHER PUBLICATIONS

Patent Abstracts Of Japan vol. 14, No. 554; (p. 838).
Chemical Abstracts An: CA114(26): 257004t.

*Primary Examiner*—Janet C. Baxter
*Attorney, Agent, or Firm*—Sughrue, Mion, Zinn, Macpeak & Seas

[57] ABSTRACT

A heat-developable photographic material having a light-sensitive silver halide, a reducing agent, a binder and a dye-donating compound on a support, in which at least one light-sensitive silver halide emulsion on the support contains from $1\times10^{-7}$ to $1\times10^{-3}$ mol, per mol of silver halide, of iron ions in the silver halide grains. The material shows little sensitivity fluctuation to variations of the temperature of exposure and shows little decrease in sensitivity on exposure with high intensity light for a short period of time, such as laser rays.

9 Claims, No Drawings

HEAT-DEVELOPABLE PHOTOGRAPHIC MATERIAL

This is a continuation of application No. 07/970,157 filed Nov. 2, 1992.

FIELD OF THE INVENTION

The present invention relates to a heat-developable photographic material and, in particular, to an excellent heat-developable photographic material which exhibits little sensitivity fluctuation with variations in the time and temperature for exposure of the material.

BACKGROUND OF THE INVENTION

Various heat-developable photographic materials are known. For example, such materials and photographic processes for processing them are described in *Bases of Photographic Engineering*, Edition of Nonsilver Photography (published by Corona Publishing Co., 1982), pages 242 to 255 and U.S. Pat. No. 4,500,626.

In addition, a method of forming a color image by a coupling reaction of an oxidation product of a developing agent and a coupler is described in, for example, U.S. Pat. Nos. 3,761,270 and 4,021,240. A method of forming a positive color image by a light-sensitive silver dye bleaching process is described in U.S. Pat. No. 4,235,957.

Recently, a dye transfer method of imagewise releasing or forming a diffusible dye by heat development followed by transferring the diffusible dye to a dye-fixing element has been proposed. In accordance with such method, both a negative color image and a positive color image can be obtained by varying the kind of the dye-donating compound used or the kind of the silver halide used. The details of such a method are given in U.S. Pat. Nos. 4,500,626, 4,483,914, 4,503,137, 4,559,290, JP-A-8-149046, JP-A-60-133449, JP-A-59-218443, JP-A-61-238056, EP-A-220746, Japanese Disclosure Bulletin 87-6199 and EP-A-210660. (The term "JP-A" as used herein means an "unexamined published Japanese patent application".)

Various methods have also been proposed for forming positive color images by heat development. For instance, U.S. Pat. No. 4,559,290 proposed a method in which an oxidized compound having no color image releasing capacity as derived from a DRR compound is, in the presence of a reducing agent or a precursor thereof, reduced with the reducing agent which remains without being oxidized after oxidation of the agent in accordance with the exposed amount of a silver halide by heat development, to release a diffusible dye. EP-A-220746 and Japanese Disclosure Bulletin 87-6199 (Vol. 12, No. 22) describe a heat-developable color photographic material comprising a compound which releases a diffusible dye by the same mechanism as mentioned above, that is, the compound releases a diffusible dye by reductive cleavage of the N—X bond of the compound (where X is an oxygen atom, a nitrogen atom or a sulfur atom).

Since such heat-developable photographic materials may be processed in a short period of time and may be processed with a simple developing apparatus, they are now in common use. With their increased popularity, they are used in many different kinds of places, and thus they have been found to involve the problem that their sensitivity often fluctuates due to fluctuations in the temperature of the place where they are used.

In order to further shorten the processing time of heat developable photographic materials, an exposure method using laser rays is in utilized. However, since exposure with laser rays is effected in a short period of time with higher light intensity than ordinary optical exposure, it involves the problem of high intensity reciprocity failure in that the sensitivity fluctuates due to variations in the light intensity imparted to photographic materials upon exposure thereof.

JP-A-51-139323 and JP-A-59-171947 and GB-A-2109576 mention that the reciprocity law failure may be improved by incorporation of a compound of a metal of Group VIII into photographic materials. JP-B-49-33781 (the term "JP-B" as used herein means an "examined Japanese patent publication"), JP-A-50-23618, JP-A-52-18310, JP-A-58 -15952, JP-A-59-214028, JP-A-61-67845, German Patents 2226877 and 2708466 and U.S. Pat. No. 3,703,584 mention that an improvement of the reciprocity law failure may be effected by incorporation of a rhodium compound or an iridium compound into photographic materials. However, incorporation of a rhodium compound causes extreme desensitization of a photographic material containing it, which is unfavorable to practical use. On the other hand, incorporation of an iridium compound often involves latent image sensitization which increases the density of developed images with the passage of time from exposure of the photographic materials to processing, which is also unfavorable to practical use.

SUMMARY OF THE INVENTION

The object of the present invention is to provide a heat-developable photographic material which exhibits little sensitivity fluctuation with variations in the time and temperature for exposure of the material.

The object of the present invention is attained by a heat-developable photographic material comprising a light-sensitive silver halide, a reducing agent, a binder and a dye-donating compound on a support, in which at least one light-sensitive silver halide emulsion on the support contains from $1\times10^{-7}$ to $1\times10^{-3}$ mol, per mol of silver halide, of iron ions in the silver halide grains.

As a preferred embodiment of the photographic material, at least one light-sensitive silver halide emulsion containing the determined amount of iron ions has a maximum spectral sensitivity wavelength in the range of 700 nm or more.

DETAILED DESCRIPTION OF THE INVENTION

The heat-developable photographic material of the present invention has "at least one light-sensitive silver halide emulsion on a support, which contains from $1\times10^{-7}$ to $1\times10^{-3}$ mol, per mol of silver halide, of iron ions in the silver halide grains", which means that the silver halide grains are formed in the presence of a predetermined amount of iron ions.

For incorporating the iron ions into the silver halide emulsion grains in the present invention, it is easy to effect formation of the emulsion grains in the presence of a water-soluble iron compound. The iron compound may be a divalent or trivalent iron ion-containing compound, which is preferred to be soluble in water. Especially preferred for the use is an iron complex salt which may easily be included into the silver halide grains. Examples of such compounds are mentioned below, which, however, are not intended to restrict the scope of the present invention.

Such compounds include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albuminate, ammonium ferric acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidinium ferric sulfate, ammonium ferric citrate, potassium hexacyanoferrate (II), potassium pentacyanoammineferrate(II), sodium ethylenedinitrilotetraacetato/iron(III), potassium hexacyanoferrate(III), tris(bipyridyl) chloride/iron(III) , and potassium pentacyanonitrosyl/iron (III).

Of these compounds, especially preferred are hexacyanoferrates (II), hexacyanoferrates (III), ferrous thiocyanates and ferric thiocyanates, as they exhibit excellent effects.

The iron compound may be incorporated into silver halide grains during formation of the silver halide grains, by adding it to an aqueous solution of a dispersing medium (gelatin or protective colloidal polymers), an aqueous solution of a halide, an aqueous solution of a silver salt or other aqueous solutions.

In the present invention, the amount of the iron compound added may be from $1\times10^{-7}$ to $1\times10^{-3}$ mol, preferably from $1\times10^{-6}$ to $5\times10^{-4}$ mol, per mol of silver halide.

In the present invention, the amount of the iron ions incorporated into the silver halide grains preferably falls within the above range. If the amount is less than the above range, the desired effects are hardly obtained. On the contrary, if it is more than the above range, the photographic material often undergoes desensitization under pressure.

The silver halide grains of the photographic material of the present invention may further contain other polyvalent metal compounds than iron ions. As such compounds, there are mentioned, for example, ions of metals of Group VIII, such as cobalt, nickel, ruthenium, rhodium, palladium, osmium, iridium and platinum. In addition, further usable are ions of the metals copper, gold, zinc, cadmium and lead.

In particular, a combination of a) iron ions and iridium ions, b) of iron ions and rhodium ions, and c) of iron ions, iridium ions and rhodium ions are preferred.

The heat-developable photographic material of the present invention basically contains a light-sensitive silver halide, a reducing agent, a binder and a dye-donating compound (this may be a reducing agent as discussed below) on a support, and it may optionally additionally contain an organic metal salt oxidizing agent, etc. These components are in most cases incorporated into one and the same layer, but they may be added separately to different layers provided that they are reactive with each other. For instance, if a colored dye-donating compound is in a layer below a silver halide emulsion layer, it is effective for preventing lowering of the sensitivity of the emulsion layer. The reducing agent can be incorporated into the heat-developable photographic material. In addition, it may also be supplied to the photographic material from the external source, for example, by diffusing it to the photographic material from the dye-fixing element.

Incorporation of the reducing agent into the photographic material of the present invention provides the effect of promoting the formation of color-images.

In order to obtain colors of a broad range in a chromaticity diagram by using the three primary colors, yellow, magenta and cyan, a combination of at least three silver halide emulsion layers each having light-sensitivity in a different spectral region is used. For instance, usable are a combination of three layers of a blue-sensitive layer, a green-sensitive layer and a red-sensitive layer, and a combination of a green-sensitive layer, a red-sensitive layer and an infrared sensitive layer. The respective light-sensitive layers may be arranged in any desired sequence as is generally employed in conventional color photographic materials. These layers each may comprise two or more plural layers each having a different sensitivity degree.

The heat-developable photographic material of the present invention may have various other auxiliary layers, such as a protective layer, as well as a subbing layer, interlayer, yellow filter layer, anti-halation layer, and backing layer.

The silver halide for use in the present invention may be any one of silver chloride, silver bromide, silver iodobromide, silver chlorobromide, silver chloroiodide and silver chloroiodobromide.

The silver halide emulsion for use in the present invention may be either a surface latent image type emulsion or an internal latent type emulsion. The latter internal latent type emulsion is used as a direct reversal emulsion, in combination with a nucleating agent or with light fogging. The emulsion may also be a core/shell emulsion in which the inside phase and the surface phase of each grain differ from each other. The silver halide emulsion may be either a monodisperse emulsion or a polydisperse emulsion. A mixture of plural monodisperse emulsions may also be used. The grain size of the emulsion grains may be from 0.1 to 2 μm, especially preferably from 0.2 to 1.5 μm. The crystal habit of the silver halide grains may be any one of a cubic, octahedral or tetradecahedral shape, or a tabular shape having a high aspect ratio.

Unless otherwise indicated, hereafter in the present specification all documents which are referred to as teaching materials or procedures, etc., useful in the present invention are incorporated by reference.

Specifically, all silver halide emulsions as described in U.S. Pat. Nos. 4,500,626 (column 50) and 4,628,021, *Research Disclosure* (hereinafter referred to as RD), No. 17029 (June, 1978), and JP-A-62-253159 can be used in the present invention.

Silver halide emulsions may be used as primitive emulsions. In general, however, they are chemically sensitized before use. For instance, any known sulfur sensitization, reduction sensitization and noble metal sensitization, which are generally applied to emulsions of conventional photographic materials, can be employed singly or in combination of them. Such chemical sensitization may also be effected in the presence of a nitrogen-containing heterocyclic compound (as disclosed in JP-A-62-253159).

The amount of light-sensitive silver halide(s) coated in preparing the photographic material for use in the present invention may be from 1 $mg/m^2$ to 10 $g/m^2$ (as silver), where the $m^2$ value is per square meter of the support.

Silver halides used in the present invention maybe color-sensitized with methine dyes or other dyes. As usable dyes for such purpose, there can be mentioned cyanine dyes, merocyanine dyes, complex cyanine dyes, complex merocyanine dyes, holopolar cyanine dyes, hemicyanine dyes, styryl dyes and hemioxonol dyes.

Specifically mentioned are the sensitizing dyes described in U.S. Pat. No. 4,617,257, JP-A-59-180550 and JP-A-60-140335, and RD No. 17029 (June, 1978), pages 12 and 13.

These sensitizing dyes may be used singly or in combination. Combinations of plural sensitizing dyes are often used for the purpose of supersensitization.

Dyes which do not have a color-sensitizing activity by themselves but show a supersensitivity activity or compounds which do not substantially absorb visible rays but show a supersensitizing activity may be incorporated into the emulsions by the present invention along with sensitizing dyes. (For instance, dyes or compounds as described in U.S. Pat. No. 3,615,641 and Japanese Patent Application No. 61-226294 (corresponding to JP-A-63-23145).)

The time of adding such sensitizing dyes into the emulsions of the present invention may be during or before or after chemical ripening of the emulsions. As the case may be, it may be before or after the formation of the nuclei of the silver halide grains, in accordance with U.S. Pat. Nos. 4,183,756 and 4,225,666. The amount of the dye(s) added is generally from $10^{-8}$ to $10^{-2}$ mol or so, per mol of silver halide.

In the present invention, an organic metal salt may be used as an oxidizing agent with the light-sensitive silver halide(s). Of such organic metal salts, especially preferred are organic silver salts.

As organic compounds used for forming such organic silver salt oxidizing agents, there can be mentioned, for example, benzotriazoles, fatty acids and other compounds described in U.S. Pat. No. 4,500,626 (columns 52 and 53). In addition, silver salts of alkynyl group-containing carboxylic acids such as silver phenylpropionate, as described in JP-A-60-113235, as well as acetylene silver as described in JP-A-61-249044 are also useful. Two or more kinds of organic silver salts may be employed in combination.

The above-mentioned organic silver salt may be added to the emulsion in an amount of from 0.01 to 10 mols, preferably from 0.01 to 1 mol, per mol of the light-sensitive silver halide. The total amount of the light-sensitive silver halide and the organic silver salt coated is suitably from 50 mg/m$^2$ to 10 g/m$^2$, as silver.

Various antifoggants and photographic stabilizers may be used in the present invention. As examples thereof, there can be mentioned azoles and azaindenes as described in RD No. 17643 (December, 1978), pages 24 and 25; nitrogen-containing carboxylic acids and phosphoric acids as described in JP-A-59-168442; mercapto compounds and metal salts thereof, as described in JP-A-59-111636; and acetylene compounds as described in JP-A-62-87957.

As the reducing agent for use in the present invention, any one which is known in the field of heat-developable photographic materials can be employed. Such agent also includes dye-donating compounds having a reducing property, which will be mentioned hereafter. In this case, another reducing agent(s) can be used, if desired, in combination with such a reducing dye-donating compound. In addition, reducing agent precursors which do not have a reducing property by themselves but which show a reducing capacity with the aid of a nucleating reagent or under heat during the step of development may also be employed.

As examples of reducing agents which can be employed in the present invention, reducing agents and reducing agent precursors as described in U.S. Pat. Nos. 4,500,626 (columns 49 and 50), 4,483,914 (columns 30 and 31), 4,330,617 and 4,590,152, JP-A-60-140355 (pages 17 and 18), JP-A-57-40245, JP-A-56-138736, JP-A-59-178458, JP-A-59-53831, JP-A-59-182449, JP-A-59-182450, JP-A-60-119555, JP-A-60-128436 through JP-A-60-128439, JP-A-60-198540, JP-A-60-181742, JP-A-61-259253, JP-A-62-244044 and JP-A-62-131253 through JP-A-62-131256 and EP-A-220746 (pages 78 to 96) can be used. Specific example of the reducing agent precursors is shown below. However, the present invention is not limited thereto.

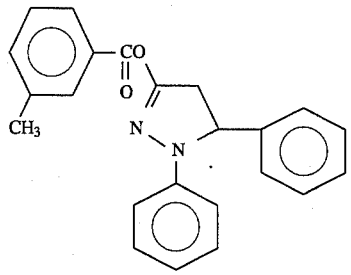

Combinations of various reducing agents as described in U.S. Pat. No. 3,039,869 can also be employed.

Where non-diffusible reducing agents are used in accordance with the present invention, an electron-transferring agent and/or an electron-transferring agent precursor can be used, if desired, in combination with such a reducing agent for the purpose of accelerating the movement of electrons between the non-diffusible reducing agent and the heat-developable silver halide.

The electron-tranferring agent or precursor thereof can be selected from the above-mentioned reducing agents and precursors thereof. The electron-transferring agent or precursor thereof is desired to have a higher mobility than the non-diffusible reducing agent (electron donor). Especially useful electron-transferring agents are 1-phenyl-3-pyrazolidones and aminophenols. Specific example of the electron-transferring agents is show below. However, the present invention is not limited thereto.

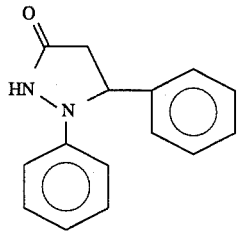

The non-diffusible reducing agent (electron donor) employed in combination with the electron-transferring agent may be any one of the above-mentioned reducing agents which are substantially immobile in the layers of a photographic material. Preferably, there can be mentioned hydroquinones, sulfonamidophenols, sulfonamidonaphthols and the compounds described in JP-A-53-110827 as electron donors, as well as non-diffusible and reducing dye-donating compounds which will later be mentioned.

In accordance with the present invention, the amount of the reducing agent or precursor thereof added is from 0.001 to 20 mols, especially preferably from 0.01 to 10 mols, per mol of silver.

The photographic material of the present invention may contain a compound which can form or release a mobile dye in correspondence or reverse correspondence with the reaction of reducing silver ion into silver under high temperature conditions, namely a dye-donating compound.

As examples of the dye-donating compounds employed in the present invention, there can be mentioned compounds (couplers) capable of forming a dye by an oxidation-coupling reaction. The coupler may be either 4-equivalent couplers or 2-equivalent couplers. 2-Equivalent couplers which have a non-diffusible group as the releasing group and which form a diffusible dye by an oxidation-coupling reaction are preferred. The non-diffusible group may be in the form of a polymer chain. Examples of color developing agents and couplers for use in the present invention are described in detail in T. H. James, *The Theory of the Photographic Process,* 4th Ed., pages 291 to 334 and 354 to 361 and in JP-A-58-123533, JP-A-58-149046, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

A further example of the dye-donating compound includes a compound adapted to imagewise release or spread a diffusible dye. Compounds of such type can be represented by the formula (LI):

$$(\text{Dye-Y})_n\text{—Z} \qquad \text{(LI)}$$

wherein Dye represents a dye group or dye precursor group whose wavelength has been temporarily shortened; Y represents a chemical bond or a linking group; Z represents a group which either causes a differential in the diffusibility of the compound $(\text{Dye-Y})_n$—Z or releases Dye and causes a differential in diffusibility between released Dye and $(\text{Dye-Y})_n$—Z in correspondence or reverse correspondence with photosensitive silver halide imagewise having a latent image; and n represents 1 or 2, and when n is equal to 2, the two Dye-Y groups may be the same as or different from each other.

As specific examples of the dye-donating compounds of the formula (LI), the following compounds (1) through (5) are mentioned. Compounds (1) through (3) form a diffusible color image (positive color image) in reverse correspondence with the development of silver halide and compounds (4) and (5) form a diffusible color image (negative color image) in correspondence with the development of silver halide.

(1) Dye developers comprising a combination of a hydroquinone developing agent and a dye component, as described in U.S. Pat. Nos. 3,134,764, 3,362,819, 3,597,200, 3,544,545 and 3,482,972. The dye developers are diffusible under alkaline conditions but become non-diffusible after reaction with silver halide.

(2) Non-diffusible compounds which release a diffusible dye under alkaline conditions but which lose such capacity when reacted with silver halide can also be used, as described in U.S. Pat. No. 4,503,137. As examples of such compounds, there-can be mentioned compounds which release a diffusible dye by an intramolecular nucleophilic substitution reaction, as described in U.S. Pat. No. 3,980,479; and compounds which release a diffusible dye by an intramolecular rearrangement reaction of the isoxazolone ring in their molecule, as described in U.S. Pat. No. 4,199,354.

(3) Non-diffusible compounds capable of reacting with a reducing agent which remains without being oxidized after development to release a diffusible dye can also be used, as so described in U.S. Pat. No. 4,559,290, EP-A-220746, U.S. Pat. No. 4,783,396, and Japanese Disclosure Bulletin 87-6199.

As examples of such compounds, there can be mentioned compounds which release a diffusible dye by an intramolecular nucleophilic substitution reaction after reduction, as described in U.S. Pat. Nos. 4,139,389 and 4,139,379 and JP-A-59-185333 and JP-A-57-84453; compounds which release a diffusible dye by an intramolecular electron-transfer reaction after reduction, as described in U.S. Pat. No. 4,232,107, JP-A-59-101649 and JP-A-61-88257 and RD No. 24025 (April, 1984); compounds which release a diffusible dye by cleavage of a single bond after reduction, as described in DE-A-3008588, JP-A-56-142530 and U.S. Pat. Nos. 4,343,893 and 4,619,884; nitro compounds which release a diffusible dye after electron reception, as described in U.S. Pat. No. 4,450,223; and compounds which release a diffusible dye after electron reception, as described in U.S. Pat. No. 4,609,610.

More preferably, there can be mentioned compounds having an N—X bond (where X is an oxygen, sulfur or nitrogen atom) and an electron-attracting group in one molecule, as described in EP-A-220746, Japanese Disclosure Bulletin 87-6199, U.S. Pat. No. 4,783,396, and JP-A-63-201653 and JP-A-63-201654; compounds having an $SO_2$—X groups (where X has the same meaning as mentioned above) and an electron-attracting group in one molecule, as described in Japanese Patent Application No. 62-106885 (corresponding to JP-A-1-26842); compounds having a PO'X bond (where X has the same meaning as mentioned above) and an electron-attracting group in one molecule, as described in JP-A-63-271344; and compounds having a C—X' bond (where X' has the same meaning as X mentioned above or means —$SO_2$—) and an electron-attracting group in one molecule, as described in JP-A-63-271341.

Above all, especially preferred are compounds having an N—X bond and an electron-attracting group in one molecule. Specific examples of such compounds include Compounds (1) to (3), (7) to (10), (12), (13), (15), (23) to (26), (31), (32), (35), (36), (40), (41), (44), (53) to (59), (64) and (70) described in EP-A-220746, and Compounds (11) to (23) described in Japanese Disclosure Bulletin 87-6199.

(4) Compounds (DDR couplers) which have a diffusible dye as the releasing group and release the diffusible dye by reaction with an oxidation product of a reducing agent are also useful. Examples of such compounds are described in British Patent 1,330,524, JP-B-8-39165 and U.S. Pat. Nos. 3,443,940, 4,474,867 and 4,483,914.

(5) Compounds (DRR compounds) which have the property of reducing silver halides and organic silver salts and which release a diffusible dye after having reduced the halides or salts can also be used. As the compounds of this type can function even in the absence of any other reducing agent, they are advantageously free of the problem of staining of images by the oxidized and decomposed product of a reducing agent. Specific examples of these compounds are described in U.S. Pat. Nos. 3,928,312, 4,053,312, 4,055,428 and 4,336,322, JP-A-59-65839, JP-A-59-69839, JP-A-53-3819 and JP-A-51-104343, RD No. 17465 (October, 1978), U.S. Pat. Nos. 3,725,062, 3,728,113 and 3,443,939, JP-A-58-116537 and JP-A-57-179840 and U.S. Pat. No. 4,500,626. As preferred examples of such DRR compounds, the compounds described in the above-mentioned U.S. Pat. No. 4,500,626 at columns 22 to 44 are useful and above all Compounds (1) to (3), (10) to (13), (16) to (19), (28) to (30), (33) to (35), (38) to (40) and (42) to (64) described in the said U.S. Patent are preferred. In addition, the compounds described in U.S. Pat. No. 4,639,408 at columns 37 to 39 are also useful.

As dye-donating compounds other than the above-mentioned couplers and the compounds of formula (LI), dye-silver compounds comprising an organic silver salt and a dye bonded to each other (RD of May 1978, pages 54 to 58), azo dyes employable in a heat-developable silver dye bleaching method (U.S. Pat. No. 4,235,957, RD of April 1976, pages 30 to 32) and leuco dyes (U.S. Pat. Nos. 3,985,565 and 4,022,617) can also be employed in the present invention.

In the present invention, the amount of the dyedonating compound is from 0.01 $g/m^2$ to 10 $g/m^2$.

The dye-donating compound, non-diffusible reducing agent and other hydrophobic additives can be incorporated into the layers of the photographic material by any known method, for example, by the method described in U.S. Pat. No. 2,322,027. In this case, high boiling point organic solvents such as those described in JP-A-59-83154, JP-A-59-178451, JP-A-59-178452, JP-A-59-178453, JP-A-59-178454, JP-A-59-178455 and JP-A-59-178457 can be used, optionally together with low boiling point organic solvents having a boiling point of from 50° C. to 160° C.

The amount of the high boiling point organic solvent used is 10 g or less, preferably 5 g or less, per gram of the dye-donating compound used. It is suitably one cc or less, more suitably. 0.5 cc or less, especially suitably 0.3 cc or less, per gram of the binder.

In addition, a dispersion method with a polymer, as described in JP-B-51-39853 and JP-A-51-59943, may also be employed.

Where a compound to be incorporated into the layers of the heat-developable material of the present invention is substantially insoluble in water, it may be dispersed in the binder in the form of fine grains, in addition to the above-mentioned methods.

Where the hydrophobic compound is dispersed in a hydrophilic colloid as a binder, various surfactants may be used. For instance, the surfactants mentioned in JP-A-59-157636, pages 37 and 38 may be used for such purpose.

The photographic material of the present invention can contain a compound having a function of activating the developability thereof and of stabilizing the image formed. Examples of such compounds which can preferably be employed in the present invention are described in U.S. Pat. No. 4,500,626 at columns 51 and 52.

In the system of forming an image by diffusion and transfer of the dye, a dye-fixing element is employed together with the light-sensitive photographic material of the present invention. Such systems can be classified into two major categories, a format in which the light-sensitive element and the dye-fixing element are separately disposed on two independent supports and a format in which the two elements are provided as coating layers on one and the same support. As regards the relation between the light-sensitive photographic material and the dye-fixing element, the relation thereof to the support and the relation thereof to a white reflective layer, those described in U.S. Pat. No. 4,500,626 at column 57 are useful in the present invention.

Since the present invention includes a system having both a light-sensitive element and a dye-fixing element on one and the same support, the photographic material of the present invention may often be referred to as a "light-sensitive element" for the sake of convenience hereafter. The dye-fixing element may also be referred to as a dye-fixing material.

The dye-fixing element which is preferably used in the present invention has at least one layer containing a mordant agent and a binder. As the mordant agent, any one known in the photographic field can be employed, and specific examples thereof include mordant compounds as described in U.S. Pat. No. 4,500,626 at columns 58 and 59, and JP-A-61-88256, pages 32 to 41; and those described in JP-A-62-244043 and JP-A-62-244036. In addition, dye-receiving high polymer compounds, for example, those described in U.S. Pat. No. 4,463,079 can also be employed.

The dye-fixing element may optionally have, if desired, auxiliary layers such as a protective layer, a peeling layer and a curling preventing layer. In particular, provision of a protective layer is helpful.

The binder for the layers constituting the light-sensitive element and the dye-fixing element of the present invention is preferably hydrophilic. As examples thereof, there can be mentioned those described in JP-A-62-253159, pages 26 to 28. Preferred are transparent or semitransparent hydrophilic binders, for example, natural compounds such as proteins (e.g., gelatin, gelatin derivatives), and polysaccharides (e.g., cellulose derivatives, starch, gum arabic, dextran, pullulan), as well as synthetic polymer compounds such as polyvinyl alcohol, polyvinyl pyrrolidone and acrylamide polymers. In addition, high water-absorbing polymers as described in JP-A-62-245260 may also be used, for example, homopolymers of vinyl monomers having an —COOM or $-SO_3M$ group (where M is a hydrogen atom or an alkali metal) or copolymers of such vinyl monomers or of such vinyl monomers and other vinyl monomers (e.g., sodium methacrylate, ammonium methacrylate and Sumikagel L-5H produced by Sumitomo Chemical Co.). These binders may be used as a combination of two or more kinds thereof, if desired.

Where a system of effecting heat development while supplying a small amount of water thereto is employed, use of the above-mentioned high water-absorbing polymers is desired as rapid absorption of water is possible. Where such a high water-absorbing polymer is incorporated into the dye-fixing layer or its protective layer, re-transfer of the dye which is transferred and fixed to the dye-fixing element to any other area can be prevented.

In the present invention, the amount of the binder coated is preferably 20 $g/m^2$ or less, especially preferably 10 $g/m^2$ or less, further preferably 7 $g/m^2$ or less.

The layers constituting the light-sensitive element and the dye-fixing element can contain a hardening agent. Examples thereof are hardening agents as described in U.S. Pat. No. 4,678,739 (column 41) and JP-A-59-116655, JP-A-62-245261 and JP-A-61-18942. Specifically, there can be mentioned aldehyde hardening agents (e.g., formaldehyde), aziridine hardening agents, epoxy hardening agents, vinylsulfone hardening agents (e.g., N,N'-ethylenebis(vinylsulfonylacetamide)ethane), N-methylol hardening agents (e.g., dimethylolurea) and high polymer hardening agents (e.g., compounds described in JP-A-62-234157).

In accordance with the present invention, the light-sensitive element and/or the dye fixing element can contain an image formation accelerator. Useful image formation accelerators include those which promote a redox reaction between a silver salt oxidizing agent and a reducing agent, those which promote the reactions of forming a dye from a dye-donating substance or decomposing a dye or releasing a diffusible dye, and those which promote the migration of a dye from the photosensitive layer to the dye-fixing layer. Classified by physicochemical function, the image formation accelerators can be classified into bases or base precursors, nucleophilic compounds, high boiling point organic solvents (oils), thermal solvents, surfactants and compounds which interact with silver or silver ions, for instance. However, each of these substances generally has plural functions and provides several of the above-mentioned effects. A detailed discussion on these substances can be found in U.S. Pat. No. 4,678,739 at columns 38 to 40.

As the base precursor, there can be mentioned salts between an organic acid which may be decarboxylated under heat and a base, as well as compounds capable of releasing an amine by an intramolecular nucleophilic substitution reaction, Rossen rearrangement or Beckmann rearrangement. Specific examples thereof are described in U.S. Pat. No. 4,511,493 and JP-A-62-65038.

In the system where heat-development and dye transfer are effected simultaneously in the presence of a small amount of water, it is preferred to incorporate the base and/or base precursor in the dye-fixing element for the purpose of improving the storage stability of the light-sensitive element.

In addition, the combination of a hardly soluble metal compound and a compound capable of complexing with the metal ion which constitutes the hardly soluble metal compound (hereinafter referred to as a "complex-forming compound") as described in EP-A-210660; as well as compounds yielding a base by electrolysis as described in JP-A-61-232451 can also be used as the base precursor. Use of the former is especially effective. The hardly soluble metal compound and the complex-forming compound are advantageously separately added to different light-sensitive element and dye-fixing element. For example, when the hardly soluble metal compound is added to the light-sensitive element, the complex-forming compound is added to the dye-fixing element.

The light-sensitive element and/or the dye-fixing element of the present invention can contain various development terminating agents for the purpose of always obtaining constant images despite fluctuations in the development temperature and the processing time for development.

The terminology "development terminating agent" as used herein means a compound which, after proper development, quickly neutralizes a base or reacts with a base to lower the base concentration in the layer in which the base is present and thereby terminates the development, or a compound which interacts with silver or a silver salt to arrest development. Specifically, there can be mentioned acid precursors- which release an acid under heat, electrophilic compounds which react with the existing base by a substitution reaction under heat, as well as nitrogen-containing heterocyclic compounds, mercapto compounds and precursors thereof. More precisely, specific examples of these compounds are described in JP-A-62-253159 (pages 31 and 32).

The layers constituting the light-sensitive element or the dye-fixing element (including any backing layer) of the present invention may contain various polymer latexes for the purpose of improving film properties, such as dimensional stability, anti-curling property, anti-sticking property, prevention of layer cracking and prevention of pressure sensitization and desensitization. Specifically, every polymer latex as described in JP-A-62-245258, JP-A-62-136648 and JP-A-62-110066 may be used for such purpose. In particular, where a polymer latex having a low glass transition point (40° C. or lower) is incorporated into the mordant layer, cracking of the layer can be prevented. On the other hand, where a polymer latex having a high glass transition point is incorporated into the backing layer, an anti-curling effect can be imparted to that layer.

The layers constituting the light-sensitive element and the dye-fixing element of the present invention may contain a plasticizer, a slipping agent as well as a high boiling point organic solvent as an agent for improving peelability between the light-sensitive element and the dye-fixing element. Usable of such materials are those described in JP-A-62-253159, page 25, and JP-A-62-245253.

In addition, for the above-mentioned purposes, various silicone oils (including all silicone oils from dimethylsilicone oil to modified silicone oils formed by introducing various organic groups into dimethylsiloxane) can be used. As examples thereof, usable are various modified silicone oils as described in the technical reference Modified Silicone Oils (published by Shin-Etsu Silicone Co.), page 6-8B. Of them, especially effective is a carboxy-modified silicone (X-22-3710, trade name).

In addition, also effective are the silicone oils as described in JP-A-62-215953 and Japanese Patent Application No. 62-23687 (corresponding to JP-A-63-46449).

The dye-fixing element can contain an anti-fading agent. Such an anti-fading agent includes an antioxidant, an ultraviolet absorbent as well as various kinds of metal complexes.

As examples of the antioxidant, there can be mentioned chroman compounds, coumaran compounds, phenol compounds (e.g., hindered phenols), hydroquinone derivatives, hindered amine derivatives and spiroindane compounds. The compounds described in JP-A-61-159644 are also effective.

As examples of the ultraviolet absorbent, there are benzotriazole compounds (U.S. Pat. No. 3,533,794), 4-thiazolidone compounds (U.S. Pat. No. 3,352,681), benzophenone compounds (JP-A-46-2784) and other compounds as described in JP-A-54-48535, JP-A-62-136641 and JP-A-61-8256. Further, ultraviolet-absorbing polymers as described in JP-A-62-260152 are also effective.

As examples of the metal complexes, there can be mentioned compounds as described in U.S. Pat. Nos. 4,241,155, 4,245,018 (columns 3 to 36) and 4,254,195 (columns 3 to 8), JP-A-62-174741 and JP-A-61-88256 (pages 27 to 29), and Japanese Patent Application Nos. 62-234103, 62-31096 and 62-230595 (corresponding to JP-A-1-75568, JP-A-63-199248 and JP-A-1-74272, respectively).

Examples of useful anti-fading agents are described in JP-A-62-215272 (pages 125 to 137).

The anti-fading agent for preventing the dye as transferred to the dye-fixing element from fading may previously be incorporated into the dye-fixing element or, alternatively, it may be supplied to the dye-fixing element from an external source such as a light-sensitive element containing the agent.

The above-mentioned antioxidant, ultraviolet absorbent and metal complex can be employed in the present invention in the form of a combination thereof.

The light-sensitive element and the dye-fixing element can contain a brightening agent. In particular, it is preferred to incorporate a brightening agent in the dye-fixing element or to supply the same to the said element from an external source such as a light-sensitive element containing the agent. As examples of the agent, compounds as described in K. Veenkataraman, *The Chemistry of Synthetic Dyes*, Vol. V, Chap. 8, and JP-A-61-143752 can be mentioned. Specifically, there can be mentioned stilbene compounds, coumarin compounds, biphenyl compounds, benzoxazolyl compounds, naphthalimide compounds, pyrazoline compounds and carbostyryl carboxy compounds.

The brightening agent can be employed in combination with the anti-fading agent, The layers constituting the light-sensitive element and the dye-fixing element of the present invention can contain various surfactants for various purposes of aiding coating, improvement of the peeling property, improvement of the sliding property, prevention of static charge and enhancement of developability. Specific examples of such surfactants are described in JP-A-62-173463 and JP-A-62-183457.

The layers constituting the light-sensitive element and the dye-fixing element of the present invention can contain organic fluorine compounds for the purpose of an improvement of the sliding property, prevention of static charge and improvement of the peeling property. As specific examples of such organic fluorine compounds, there can be mentioned fluorine surfactants as described in JP-B-57-9053 (columns 8 to 17) and JP-A-61-20944 and JP-A-62-135826, as well as hydrophobic fluorine compounds such as fluorine oils and like oily fluorine compounds and ethylene tetrafluoride resins and like solid fluorine compound resins.

The light-sensitive element and the dye-fixing element can contain a mat agent. As the mat agent, there can be mentioned silicon dioxide and compounds as described in JP-A-61-88256 (page 29) such as polyolefins or polymethacrylates, as well as compounds as described in Japanese Patent Application Nos. 62-110064 and 62-110065 (corresponding to JP-A-63-274944 and JP-A-63-274952, respectively) such as benzoguanamine resin beads, polycarbonate resin beads and AS (acrylonitrile-styrene) resin beads.

In addition, the layers constituting the light-sensitive element and the dye-fixing element may further contain a thermal solvent, a defoaming agent, a microbicidal and fungicidal agent, colloidal silica and other additives. Examples of such additives are described in JP-A-61-88256 (pages 26 to 32).

The support which is employed in preparing the light-sensitive element and the dye-fixing element of the present invention may be any support that withstands the processing temperature. In general, paper and synthetic high polymer films are used as the support. Specifically, the support includes films of polyethylene terephthalate (PET), polycarbonates, polyvinyl chloride, polystyrene, polypropylene, polyimide, celluloses (e.g., triacetyl cellulose) and those films containing a pigment such as titanium oxide; synthetic paper made of polypropylene by a filming method; mixed paper made of a synthetic resin pulp (e.g., polyethylene) and a natural pulp; as well as Yankee paper, baryta paper, coated paper (especially cast-coated paper), metals, cloth and glass.

These supports may be used directly as they are or may be used in the form as coated with a synthetic high polymer substance (e.g., polyethylene) on one surface or both surfaces thereof. In addition, supports as described in JP-A-62-253159, pages 29 to 31 can also be employed in the present invention.

The surface of the support may be coated with a hydrophilic binder and a semiconductive metal oxide (e.g., an alumina sol or tin oxide) or an antistatic agent such as carbon black.

For imagewise exposing and recording an image on the light-sensitive element of the present invention, various methods can be employed, which include, for example, a method of directly photographing a scene or man with a camera; a method of exposing an image through a reversal film or negative film by the use of a printer or an enlarger; a method of scanning and exposing an original through a slit by the use of an exposing device of a duplicator; a method of exposing image information via a corresponding electric signal by emitting the same with an emitting diode or various lasers; and a method of outputting image information with an image display device such as a CRT, liquid crystal display, electroluminescence display or plasma display and then exposing the same directly or via some optical system.

As the light source used for recording an image on the light-sensitive element of the present invention, those as described in U.S. Pat. No. 4,500,626 (column 56), such as natural light, a tungsten lamp, a light-emitting diode, laser rays and CRT rays can be employed, as mentioned above.

As the image information applied to the light-sensitive element of the present invention, any image signals obtained from a video camera or electronic still camera; television signals as standardized by the Nippon Television Signal Code (NTSC); image signals obtained by dividing an original into plural pixels with a scanner; and image signals formed by the use of a computer such as CG or CAD, can be employed.

The heating temperature in the heat-development step of the present invention may be from about 50° C. to about 250° C. An especially useful temperature is from about 80° C. to about 180° C. The step of diffusing and transferring the dye formed by development may be effected simultaneously with the heat-development step or after the same. In the latter case, the heating temperature in the transfer step may be from the temperature in the previous heat-development step to room temperature. Preferably, it is from 50° C. to a temperature lower than the temperature in the heat-development step by about 10° C.

Migration of the dye formed may be effected only by heat, but a solvent may be used for the purpose of accelerating the migration of the dye.

Further, as described in detail in JP-A-59-218443 and JP-A-61-238056, a method where development and transfer are carried out in the presence of a small amount of a solvent (especially, water) under heat, either at the same time or in a continuous sequence, can be advantageously utilized. In this method, the heating temperature is preferably not lower than 50° C. and not higher than the boiling point of the solvent used. For instance, where the solvent is water, the temperature is desirably from 50° C. to 100° C.

As examples of the solvents used for the acceleration of development and/or migration of the diffusible dye formed to the dye-fixing element, there can be mentioned water and an aqueous basic solution containing an inorganic alkali metal salt or an organic base. As the bases, those mentioned hereinbefore as image formation accelerators can be employed. In addition, a low boiling point solvent or a mixed solvent comprising a low boiling point solvent and water or an aqueous basic solution can also be used. Further, surfactants, antifoggants as well as hardly soluble metals and complex-forming compounds can be incorporated into the solvents.

The solvent can be used by applying the same to either the dye-fixing element or the light-sensitive element or to both of them. The amount thereof used may be a small amount of less than the weight of the solvent corresponding to the maximum swollen volume of the total coated layers (especially less than the amount obtained by subtracting the weight of the total coated layers from the weight of the solvent corresponding to the maximum swollen volume of the total coated layers).

As a method of applying the solvent to the light-sensitive layer or the dye-fixing layer, for example, a method as described in JP-A-61-147244 (page 26) can be employed. Apart from this, the solvent can be incorporated into-either the light-sensitive element or the dye-fixing element or into both of them in the form of solvent-containing microcapsules.

In order to accelerate the migration of the dye formed, a system of incorporating a hydrophilic thermal solvent which is solid at room temperature but which can melt at a high temperature into a light-sensitive element or into a dye-fixing element may also be employed in the present invention. In employing this system, the hydrophilic thermal solvent may be incorporated into either the light-sensitive element or the dye-fixing element or into both of them. The layer to which the solvent is added may be any of the emulsion layer, interlayer, protective layer and dye-fixing layer, but the solvent is preferably added to the dye-fixing layer and/or layer(s) adjacent thereto.

As examples of the thermal solvent to be employed in such a system, there can be mentioned ureas, pyridines, amides, sulfonamides, imides, alcohols, oximes and other heterocyclic compounds.

Also, to accelerate the migration of the dye formed, a high boiling point organic solvent may be incorporated into the light-sensitive element and/or the dye-fixing element.

For heating the elements in the development step and/or the transfer step, they may be kept in contact with a heated block or plate, or with a hot plate, hot presser, hot roller, halogen lamp heater or infrared or far-infrared lamp heater or may be passed through a high temperature atmosphere. If desired, a heat generating resistor layer may be provided in the light-sensitive element or the dye-fixing element, to which an electric current can be applied so as to heat the same. As the heating element, one useful one is described in JP-A-61-145544.

Where the light-sensitive element is attached to the dye-fixing element and the two are united together under pressure, a method as described in JP-A-6! -147244 (page 27) is applicable to the present invention with respect to the pressure conditions and the means of pressing the united elements.

For processing the photographic elements of the present invention, any general heat-developing apparatus can be utilized. For instance, the apparatus as described in JP-A-59-75247, JP-A-59-177547, JP-A-59-181353 and JP-A-60-18951 and JU-A-62-25944 are preferably employed (the term "JU-A" as used herein means an "examined Japanese utility application").

The present invention will be explained in more detail with reference to the following examples, which, however, are not intended to restrict the scope of the present invention.

In the following examples, when x g of a solute is dissolved in a solvent to obtain 100 g of a solution, the concentration of the solute in the solution is represented as x%. That is, "5% gelatin solution" means 5 g of gelatin per 100 g of a gelatin solution.

EXAMPLE 1

Preparation of a dispersion of zinc hydroxide 12.5 g of zinc hydroxide having a mean grain size of 0.2 μm, 1 g of carboxymethyl cellulose as a dispersing agent, and 0.1 g of sodium polyacrylate were added to 100 ml of an aqueous 4% gelatin solution and ground in a mill with glass beads having a mean grain size of 0.75 mm for 30 minutes. The glass beads were separated to obtain a dispersion of zinc hydroxide.

Preparation of a dispersion of an electron transferring agent 10 of electron-transferring agent (1), 0.5 g of polyethylene glycol nonylphenyl ether as a dispersing agent, and 0.5 g of anionic surfactant (1) were added to 100 g of an aqueous 5% gelatin solution and ground in a mill with glass beads having a mean grain size of 0.75 mm for 60 minutes. The glass beads were separated to obtain a dispersion of electron-transferring agent having a mean grain size of 0.4 μm.

Electron-Transferring Agent (1):

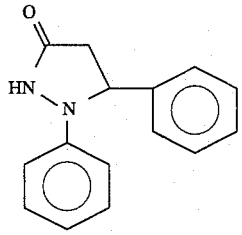

Anionic Surfactant (1):

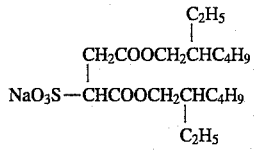

Preparation of a dispersion of a dye trapping agent

While stirring a mixture comprising 108 ml of polymer latex (A) (solids content: 13%), 20 g of surfactant (2) and 1232 ml of water, 600 ml of an aqueous 5% solution of anionic surfactant (3) was added thereto over a period of 10 minutes. The dispersion thus prepared was concentrated to 500 ml and desalted through an ultrafilter module. Next, 1500 ml of water was added thereto, and the same operation was again repeated. Thus, 500 g of a dye trapping agent dispersion was obtained. The dye trapping agent dispersion is coated as the second layer as shown in Table 8.

Polymer Latex (A):

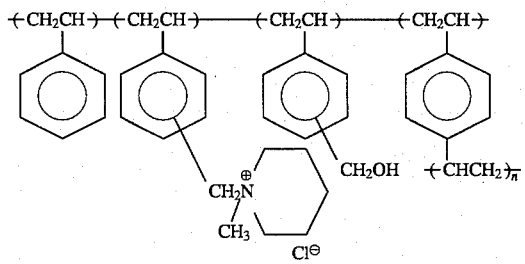

Surfactant (2):

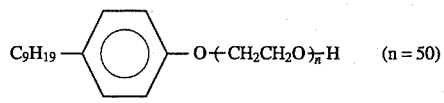

Anionic Surfactant (3):

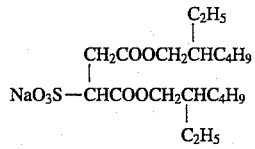

Preparation of gelatin dispersions of hydrophobic additives

Individual gelatin dispersions of cyan, magenta, yellow and electron donors were prepared, each having the formulation shown in Table 1. Briefly, the components of the oily phase were dissolved under heat at about 60° C. to form a uniform solution, and the solution was blended and stirred with the components of the aqueous phase as heated at about 60° C. The resulting mix was then dispersed in a homogenizer for 10 minutes at 10,000 rpm. Water of a predetermined amount was added thereto to obtain a uniform dispersion.

TABLE 1

| Dispersion | | Cyan | Magenta | Yellow | Electron Donor |
|---|---|---|---|---|---|
| Oily Phase | Dye-Donating Compound (1) | 11.31 g | — | — | — |
| | Dye-Donating Compound (2) | 3.87 g | — | — | |
| | Dye-Donating Compound (3) | — | 15.5 g | — | — |
| | Dye-Donating Compound (4) | — | — | 13.0 g | — |
| | Electron Donor (1) | 5.83 g | 5.61 g | 6.47 g | — |
| | Electron Donor (2) | — | — | — | 12.68 g |
| | Electron Donor (3) | — | — | — | 2.63 g |
| | Electron-Transferring Agent Precursor (A) | 1.42 g | 1.42 g | 0.86 g | — |
| | Compound (1) | 0.46 g | 0.56 g | 0.64 g | — |
| | Compound (2) | — | — | — | 0.82 g |
| | High Boiling Point Solvent (1) | 3.80 g | 3.88 g | 5.20 g | 5.10 g |
| | High Boiling Point Solvent (2) | — | — | 3.90 ml | — |
| | Surfactant (1) | 3.80 g | 3.88 g | — | — |
| | Surfactant (2) | — | — | 1.50 g | 0.45 g |
| | Ethyl Acetate | — | — | 37.0 ml | 23.8 ml |
| | Methyl Ethyl Ketone | 74.0 ml | 74.0 ml | — | — |
| | Cyclohexanone | — | — | — | 1.85 ml |
| Aqueous Phase | Lime-Processed Gelatin | 10.0 g | 10.0 g | 10.0 g | 10.0 g |
| | Citric Acid | — | — | 0.20 g | 0.06 g |
| | Sodium Hydrogensulfite | — | — | — | 0.15 g |
| | Water | 230 ml | 230 ml | 150 ml | 63.0 ml |
| | Water Added | 92.0 ml | 92.0 ml | 100 ml | 90.0 ml |

Dye-Donating Compound (1):

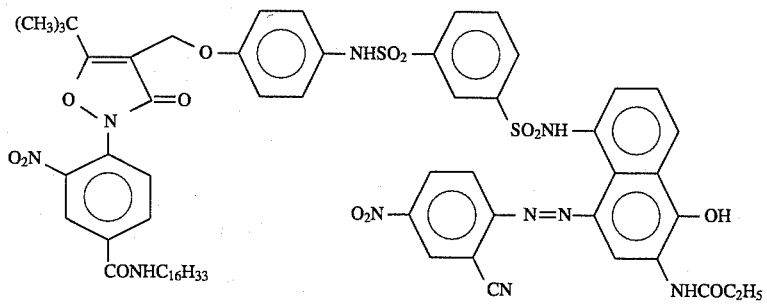

Dye-Donating Compound (2):

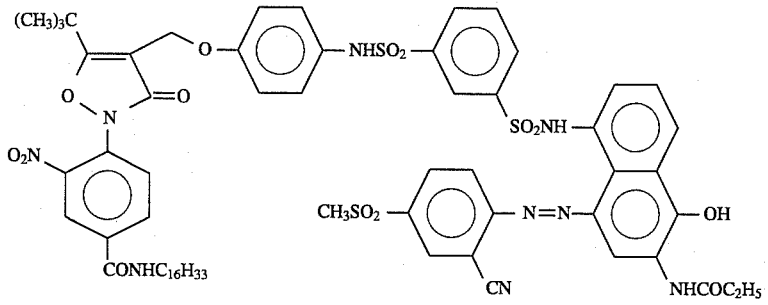

Dye-Donating Compound (3):
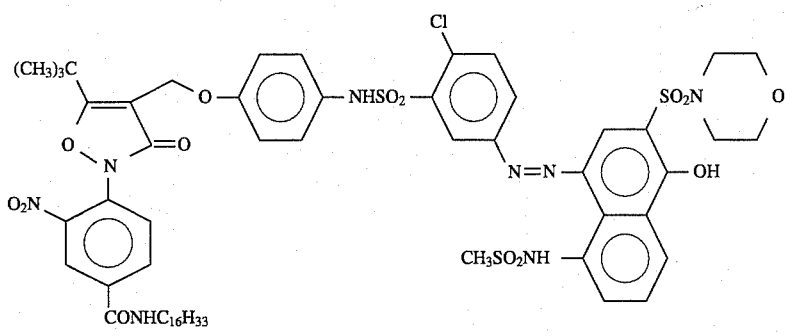
Dye-Donating Compound (4):
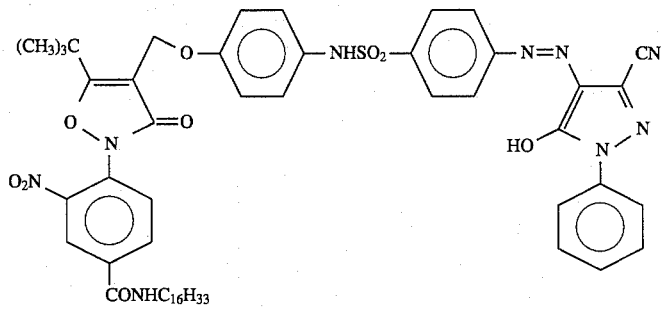
Electron Donor (1):
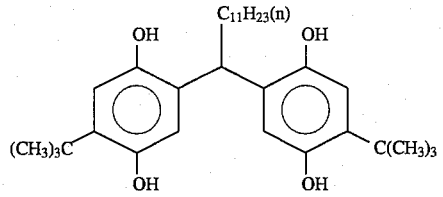
Electron Donor (2):
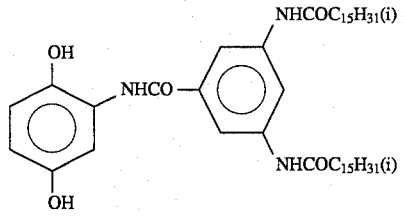
Electron Donor (3):
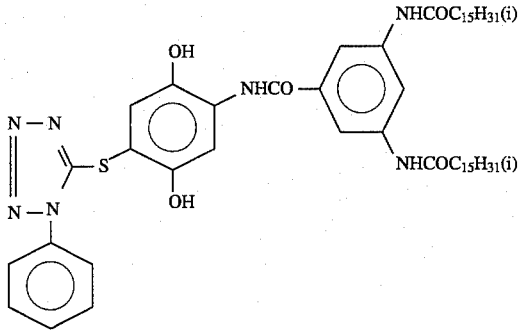
Electron-Transferring Agent Precursor (A):
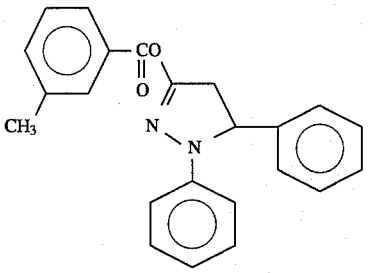

Compound (1):

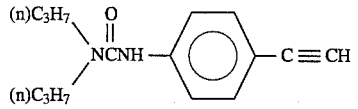

Compound (2):

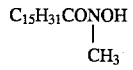

High Boiling Point Solvent (1):

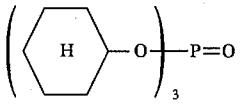

High Boiling Point Solvent (2):

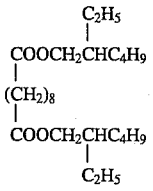

Preparation of light-sensitive silver halide emulsions

Light-Sensitive Silver Halide Emulsion (1) (for red-sensitive emulsion layer):

Solution (I) and solution (II) shown in Table 2 were simultaneously added to a well stirred aqueous gelatin solution (prepared by adding 20 g of gelatin, 0.5 g of potassium bromide, 3 g of sodium chloride and 30 mg of chemical substance (A) to 480 ml of water and then keeping at 45° C.), over a period of 20 minutes at the same flow rate for each solution (hereafter, simply "same flow rate"). After 5 minutes, solution (III) and solution (IV) also shown in Table 2 were simultaneously added thereto over a period of 25 minutes at the same flow rate. 10 minutes after initiation of the addition of solution (III) and solution (IV), an aqueous solution of a gelatin dispersion of dyes (containing 1 g of gelatin, 67 mg of dye (a), 133 mg of dye (b) and 4 mg of dye (c) in 105 ml of water and kept at 45° C.) was added to the system over a period of 20 minutes.

The resulting product was rinsed with water and desalted by a conventional method, and 22 g of lime-processed ossein gelatin was added thereto, and the pH of the system was adjusted to be 6.2 with the pAg thereof adjusted to 7.7. The resulting product was subjected to optimum chemical sensitization at 60° C. by adding sodium thiosulfate, 4-hydroxy-6-methyl-1,3,3a,7-tetrazaindene and chloroauric acid thereto. Accordingly, 635 g of a monodisperse cubic silver chlorobromide emulsion having a mean grain size of 0.30 μm was obtained.

Chemical Substance (A):

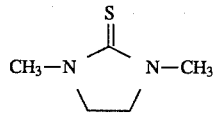

TABLE 2

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| | Water to make 250 ml | Water to make 250 ml | Water to make 200 ml | Water to make 200 ml |

Dye (a):

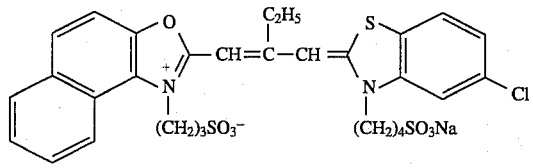

Dye (b):

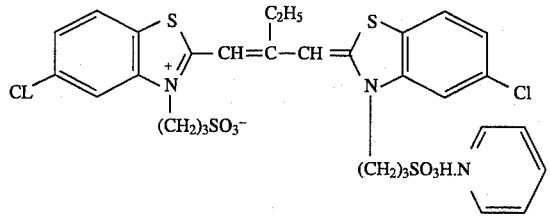

Dye (c):

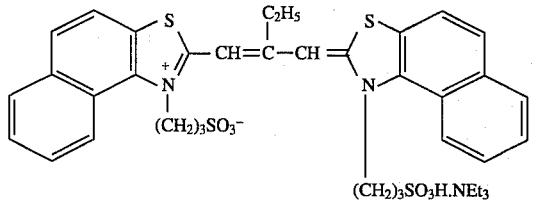

Light-Sensitive Silver Halide Emulsion (2) (for red-sensitive emulsion layer):

Solution (I) and solution (II) shown in Table 3 were simultaneously added to a well stirred aqueous gelatin solution (prepared by adding 20 g of gelatin, 0.5 g of potassium bromide, 6 g of sodium chloride and 30 mg of chemical substance (A) to 783 ml of water and keeping at 65° C.), over a period of 30 minutes at the same flow rate. After 5 minutes, solution (III) and solution (IV) also shown in Table 3 were simultaneously added thereto over a period of 15 minutes at the same flow rate. 2 minutes after initiation of the addition of solution (III) and solution (IV), an aqueous solution of a gelatin dispersion of dyes (containing 0.9 g of gelatin, 61 mg of dye (a), 121 mg of dye (b) and 4 mg of dye (c) in 95 ml of water and keeping at 50° C.) was added to the system over a period of 18 minutes.

The resulting product was rinsed with water and desalted by a conventional method, and 22 g of lime-processed ossein gelatin was added thereto, and the pH thereof was adjusted to 6.2 with the pAg thereof adjusted to 7.7. This product was then subjected to optimum chemical sensitization at 60° C., by adding sodium thiosulfate, 4-hydroxy-6-methyl-1,3,3a,7-tetrazaindene and chloroauric acid thereto. Accordingly, 635 g of a mono-disperse cubic silver chlorobromide emulsion having a mean grain size of 0.50 μm was obtained.

TABLE 3

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| | Water to make 200 ml | Water to make 140 ml | Water to make 145 ml | Water to make 155 ml |

Light-Sensitive Silver Halide Emulsion (3) (for green-sensitive emulsion layer):

Solution (I) and solution (II) shown in Table 4 below were simultaneously added to a well stirred aqueous gelatin solution (prepared by adding 20 g of gelatin, 0.5 g of potassium bromide, 4 g of sodium chloride and 15 mg of chemical substance (A) to 675 ml of water and keeping at 48° C.), over a period of 10 minutes at the same flow rate. After 10 minutes, solution (III) and solution (IV) also shown in Table 4 were simultaneously added thereto over a period of 20 minutes at the same flow rate. One minute after the addition of solution (III) and solution (IV), an aqueous solution of a gelatin dispersion of a dye (containing 3.0 g of gelatin and 300 mg of dye (d) in 120 ml of water and keeping at 45° C.) was added to the system all at one time.

The resulting product was rinsed with water and desalted by a conventional method, and 20 g of lime-processed ossein gelatin was added thereto, the pH thereof being adjusted to be 6.0 with the pAg thereof adjusted to 7.6. The resulting product was then subjected to optimum chemical sensitization at 68° C. by adding sodium thiosulfate, 4-hydroxy-6-methyl-1,3,3a,7-tetrazaindene and chloroauric acid thereto. As a result, 635 g of a mono-disperse cubic silver chlorobromide emulsion having a mean grain size of 0.27 μm was obtained.

TABLE 4

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.25 g | — | 0.25 g | — |
| KBr | — | 21.0 g | — | 28.0 g |
| NaCl | — | 6.90 g | — | 3.45 g |
| | Water to make 200 ml | Water to make 150 ml | Water to make 200 ml | Water to make 150 ml |

Dye (d):

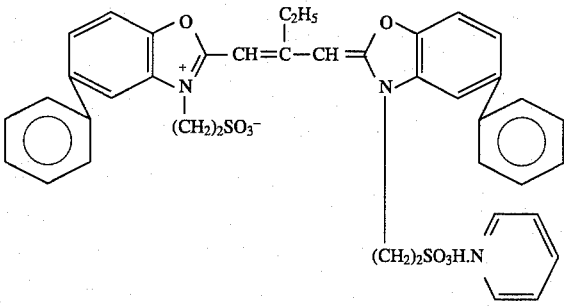

Light-Sensitive Silver Halide Emulsion (4) (for green-sensitive emulsion layer):

Solution (I) and solution (II) shown in Table 5 below were simultaneously added to a well stirred aqueous gelatin solution (prepared by adding 20 g of gelatin, 0.3 g of potassium bromide, 6 g of sodium chloride and 15 mg of chemical substance (A) to 675 ml of water and keeping at 55° C.), over a period of 20 minutes at the same flow rate. After 10 minutes, solution (III) and solution (IV) also shown in Table 5 were simultaneously added thereto over a period of 20 minutes at the same flow rate. One minute after the addition of solution (III) and solution (IV), an aqueous solution of a gelatin dispersion of a dye (containing 2.5 g of gelatin and 250 mg of dye (d) in 95 ml of water and keeping at 45° C.) was added to the system all at one time.

The resulting product was rinsed with water and desalted by a conventional method, and 20 g of lime-processed ossein gelatin was added thereto, and the pH thereof was adjusted to 6.0 with the pAg thereof adjusted to 7.6. The resulting product was the subjected to optimum chemical sensitization at 68° C., by adding sodium thiosulfate, 4-hydroxy-6-methyl-1,3,3a,7-tetrazaindene and chloroauric acid thereto. Thus, 635 g of a monodisperse cubic silver chlorobromide emulsion having a mean grain size of 0.42 μm was obtained.

TABLE 5

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.25 g | — | 0.25 g | — |
| KBr | — | 28.0 g | — | 35.0 g |
| NaCl | — | 3.45 g | — | — |
| | Water to make 200 ml | Water to make 200 ml | Water to make 150 ml | Water to make 150 ml |

Light-Sensitive Silver Halide Emulsion (5) (for blue-sensitive emulsion layer):

Solution (I) and solution (II) shown in Table 6 below were simultaneously added to a well stirred aqueous gelatin solution (prepared by adding 20 g of gelatin, 0.5 g of potassium bromide, 4 g of sodium chloride and 15 mg of chemical substance (A) to 675 ml of water and keeping at 50° C.), over a period of 8 minutes at the same flow rate. After 10 minutes, solution (III) and solution (IV) also shown in Table 6 were simultaneously added thereto over a period of 32 minutes at the same flow rate. One minute after the addition of solution (III) and solution (IV), an aqueous solution of dyes (containing 220 mg of dye (e) and 110 mg of dye (f) in 95 ml of water and 5 ml of methanol and keeping at 45° C.) was added to the system all at one time.

The resulting product was rinsed with water and desalted by a conventional method, and 22 g of lime-processed ossein gelatin was added thereto, and the pH thereof was adjusted to 6.0 with the pAg thereof adjusted to 7.8. The resulting product was then subjected to optimum chemical sensitization at 68° C., by adding sodium thiosulfate and 4-hydroxy-6-methyl-1,3,3a,7-tetrazaindene thereto. Thus, 635 g of a monodisperse cubic silver chlorobromide emulsion having a mean grain size of 0.30 μm was obtained.

TABLE 6

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.10 g | — | 0.40 g | — |
| KBr | — | 9.8 g | — | 44.8 g |
| NaCl | — | 2.60 g | — | 5.52 g |
| | Water to make 80 ml | Water to make 80 ml | Water to make 240 ml | Water to make 240 ml |

TABLE 6-continued

| | Solution (I) | Solution (II) | Solution (III) | Solution (IV) |
|---|---|---|---|---|

Dye (e):

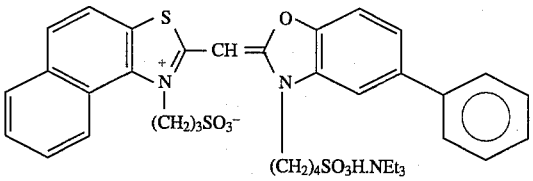

Dye (f):

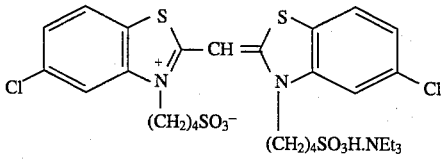

Light-Sensitive Silver Halide Emulsion (6) (for blue-sensitive emulsion layer):

Solution (I) and solution (II) shown in Table 7 below were simultaneously added to a well stirred aqueous gelatin solution (prepared by adding 20 g of gelatin, 0.3 g of potassium bromide, 9 g of sodium chloride and 15 mg of chemical substance (A) to 675 ml of water and keeping at 65° C.), over a period of 10 minutes at the same flow rate. After 10 minutes, solution (III) and solution (IV) also shown in Table 7 were simultaneously added thereto over a period of 30 minutes at the same flow rate. One minute after the addition of solution (III) and solution (IV), an aqueous solution of dyes (containing 150 mg of dye (e) and 75 mg of dye (f) in 66 ml of water and 4 ml of methanol and keeping at 60° C.) was added to the system all at one time.

The resulting product was rinsed with water and desalted by a conventional method, and 22 g of lime-processed ossein gelatin was added thereto, and pH of this was adjusted to be 6.0 with pAg thereof to 7.8. The resulting product was then subjected to optimum chemical sensitization at 68° C., by adding sodium thiosulfate, 4-hydroxy-6-methyl-1,3,3a,7-tetrazaindene and chloroauric acid thereto. Thus, 635 g of a monodisperse cubic silver chlorobromide emulsion having a mean grain size of 0.55 μm was obtained.

TABLE 7

| | Solution (I) | Solution (II) | Solution (III) | Solution (IV) |
|---|---|---|---|---|
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.58 g | — | 5.18 g |
| | Water to make 100 ml | Water to make 100 ml | Water to make 225 ml | Water to make 225 ml |

Using the above materials, photographic material sample No. 101 having the constitution shown in Table 8 was prepared.

TABLE 8

Constitution of Photographic Material Sample No. 101

| Number of Layer | Name of Layer | Components | Amount Coated ($mg/m^2$) |
|---|---|---|---|
| 7th Layer | Protective Layer II | Gelatin | 440 |
| | | Silica (size 4μ) | 40 |
| | | Zinc Hydroxide | 570 |
| | | Colloidal Silver | 1 |
| | | Surfactant (3) | 16 |
| | | Dextran | 25 |
| | | Water-soluble Polymer (1) | 2 |
| 6th Layer | Protective Layer I | Gelatin | 224 |
| | | Zinc Hydroxide | 165 |
| | | Electron Donor (2) | 52 |
| | | Electron Donor (3) | 11 |
| | | Compound (2) | 3.4 |
| | | High Boiling Point Solvent (1) | 21 |
| | | Surfactant (3) | 3.6 |
| | | Dextran | 13 |
| | | Water-soluble Polymer (1) | 1.4 |
| | | Polymer Latex (1) | 22 |
| | | Surfactant (4) | 5 |
| | | Surfactant (5) | 8.4 |
| 5th Layer | Blue-sensitive Emulsion Layer | Light-sensitive Silver Halide Emulsion (5) | 360 (as Ag) |
| | | Light-sensitive Silver Halide Emulsion (6) | 105 (as Ag) |
| | | Dye-donating Compound (4) | 429 |
| | | Gelatin | 560 |
| | | Electron Donor (1) | 213 |
| | | Electron-transferring Agent Precursor (A) | 28 |
| | | Compound (1) | 21 |
| | | High Boiling Point Solvent (1) | 172 |
| | | High Boiling Point Solvent (2) | 120 |
| | | Surfactant (2) | 49 |
| | | Anti-foggant (1) | 1.2 |
| | | Water-soluble Polymer (1) | 2 |
| 4th Layer | Interlayer | Gelatin | 540 |

TABLE 8-continued

| | | | |
|---|---|---|---|
| | | Electron Donor (2) | 149 |
| | | Electron Donor (3) | 31 |
| | | Compound (2) | 9.6 |
| | | High Boiling Point Solvent (1) | 60 |
| | | Surfactant (2) | 5.3 |
| | | Surfactant (3) | 10 |
| | | Electron-Transferring Agent (1) | 78 |
| | | Dextran | 37 |
| | | Hardening Agent (1) | 31 |
| | | Hardening Agent (2) | 10 |
| | | Water-soluble Polymer (1) | 10 |
| 3rd Layer | Green-sensitive Emulsion Layer | Light-sensitive Silver Halide Emulsion (3) | 232 (as Ag) |
| | | Light-sensitive Silver Halide Emulsion (4) | 66 (as Ag) |
| | | Dye-donating Compound (3) | 363 |
| | | Gelatin | 380 |
| | | Electron Donor (1) | 131 |
| | | Electron-transferring Agent Precursor (A) | 33 |
| | | Compound (1) | 13 |
| | | High Boiling Point Solvent (1) | 91 |
| | | Surfactant (1) | 91 |
| | | Anti-foggant (1) | 1.5 |
| | | Water-soluble Polymer (1) | 10 |
| 2nd Layer | Interlayer | Gelatin | 637 |
| | | Zinc Hydroxide | 467 |
| | | Electron Donor (2) | 148 |
| | | Electron Donor (3) | 31 |
| | | Compound (2) | 9.6 |
| | | High Boiling Point Solvent (1) | 60 |
| | | Surfactant (2) | 5.3 |
| | | Surfactant (3) | 10 |
| | | Dextran | 37 |
| | | Water-soluble Polymer (1) | 4.0 |
| | | Polymer Latex (1) | 63 |
| | | Surfactant (4) | 14 |
| | | Surfactant (5) | 24 |
| 1st Layer | Red-sensitive Emulsion Layer | Light-sensitive Silver Halide Emulsion (1) | 158 (as Ag) |
| | | Light-sensitive Silver Halide Emulsion (2) | 64 (as Ag) |
| | | Dye-donating Compound (1) | 242 |
| | | Dye-donating Compound (2) | 83 |
| | | Gelatin | 326 |
| | | Electron Donor (1) | 115 |
| | | Electron-transmitting Agent Precursor (A) | 30 |
| | | Compound (1) | 9.8 |
| | | High Boiling Point Solvent (1) | 81 |
| | | Surfactant (1) | 81 |
| | | Surfactant (3) | 1.0 |
| | | Antifoggant (2) | 0.8 |
| | | Water-soluble Polymer (1) | 15 |
| Support (1) | | Polyethylene-laminated Paper Support (thickness 143 μm) | |

Support (1)

| Layer | Components | Thickness (μm) |
|---|---|---|
| Surface Subbing Layer | Gelatin | 0.1 |
| Surface PE Layer (glossy) | Low-density Polyethylene (density 0.923): 89.2 parts<br>Surface-treated Titanium Oxide: 10.0 parts<br>Ultramarine: 0.8 parts | 45.0 |
| Pulp Layer | High-quality Paper (LBKP/NBKP = 1/1, density 1.080) | 62.0 |
| Back PE Layer (mat) | High-density Polyethylene (density 0.960) | 36.0 |
| Back Subbing Layer | Gelatin | 0.05 |
| | Colloidal Silica | 0.05 |
| | | 143.2 |

Surfactant (3):

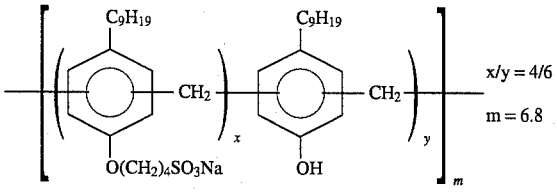

Surfactant (4):

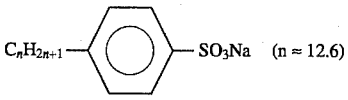

Surfactant (5):

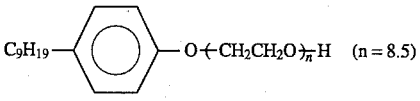

Anti-Foggant (1):

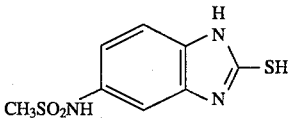

Anti-Foggant (2):

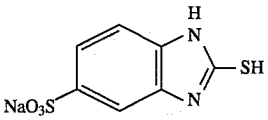

Water-Soluble Polymer (1):

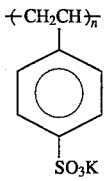

Polymer Latex (1):

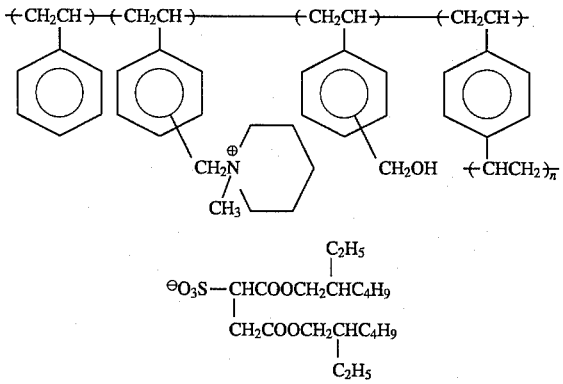

Hardening Agent (1):

$CH_2{=}CHSO_2CH_2CONH(CH_2)_2NHCOCH_2SO_2CH{=}CH_2$

Hardening Agent (2):

$CH_2{=}CHSO_2CH_2CONH(CH_2)_3NHCOCH_2SO_2CH{=}CH_2$

Photographic material samples Nos. 102 to 105 were prepared in the same manner as for the preparation of photographic material sample No. 101, except that potassium hexacyanoferrate(II) trihydrate in an amount as indicated in Table 9 was added to solution (IV) for preparing light-sensitive silver halides (3) and (4).

It was confirmed by atomic absorption analysis that 70% or more of the iron ions added were contained in the grains.

TABLE 9

| Photographic Material Sample | Light-Sensitive Silver Halide | Amount of Iron (II) Ion Added to Solution IV (mol/mol of Ag) |
|---|---|---|
| 101 (comparative sample) | (3) | None |
| | (4) | None |
| 102 (comparative sample) | (3)-1 | $3.5 \times 10^{-3}$ |
| | (4)-1 | $5.0 \times 10^{-3}$ |
| 103 (sample of the invention) | (3)-2 | $7.0 \times 10^{-5}$ |
| | (4)-2 | $1.0 \times 10^{-4}$ |
| 104 (sample of the invention) | (3)-3 | $1.4 \times 10^{-5}$ |
| | (4)-3 | $2.0 \times 10^{-5}$ |
| 105 (sample of the invention) | (3)-4 | $2.8 \times 10^{-6}$ |
| | (4)-4 | $4.0 \times 10^{-6}$ |

Preparation of an image-receiving material sample

Image-receiving material sample R101 having the constitution as shown in Table 10 below was prepared.

TABLE 10

Constitution of Image-Receiving Material Sample R101

| Number of Layer | Components | Amount Coated ($mg/m^2$) |
|---|---|---|
| 3rd Layer | Carrageenan | 58 |
| | Water-soluble Polymer (2) | 239 |
| | Guanidine Picolinate | 450 |
| | Surfactant (3) | 10 |
| | Surfactant (6) | 26 |
| | Surfactant (7) | 100 |
| 2nd Layer | Gelatin | 1360 |
| | High Boiling Point Solvent (3) | 1330 |
| | Brightening Agent | 53 |
| | Compound (3) | 63 |
| | Surfactant (1) | 17 |
| | Surfactant (2) | 23 |
| | Mordant Agent | 2350 |
| | Dextran | 610 |
| | Water-soluble Polymer (2) | 210 |
| | Guanidine Picolinate | 2360 |
| 1st Layer | Gelatin | 490 |
| | Water-soluble Polymer (2) | 40 |
| | Surfactant (7) | 11 |
| | Hardening Agent (3) | 340 |
| Support (2) | Polyethylene-laminated Paper Support (thickness 164 μm) | |
| 1st Backing Layer | Gelatin | 2950 |
| | Water-soluble Polymer (1) | 40 |
| | Hardening Agent (3) | 125 |
| 2nd Backing Layer | Gelatin | 430 |
| | Water-soluble Polymer (3) | 80 |
| | Surfactant (3) | 45 |
| | Surfactant (8) | 10 |
| | Water-soluble Polymer (1) | 3 |
| | Mat Agent | 30 |

TABLE 10-continued

| Constitution of Image-Receiving Material Sample R101 | | |
|---|---|---|
| Support (2) | | |
| Layer | Components | Thickness (μm) |
| Surface Subbing Layer | Gelatin | 0.1 |
| Surface PE Layer (glossy) | Low-density Polyethylene (density 0.923): 89.2 parts<br>Surface-treated Titanium Oxide: 10.0 parts<br>Ultramarine: 0.8 parts | 45.0 |
| Pulp Layer | High-quality Paper (LBKP/NBKP = 1/1, density 1.080) | 82.6 |
| Back PE Layer (mat) | High-density Polyethylene (density 0.960) | 36.0 |
| Back Subbing Layer | Gelatin<br>Colloidal Silica | 0.05<br>0.05 |
| | | 163.8 |

Water-Soluble Polymer (2):

Sumikagel L5-H (produced by Sumitomo Chemical Co.)

Surfactant (6):

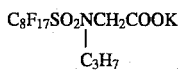

Surfactant (7):

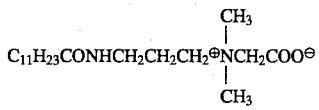

Surfactant (8):

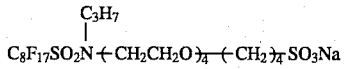

High-Boiling Point Solvent (3):

$C_{26}H_{46.9}Cl_{7.1}$

Brightening Agent:

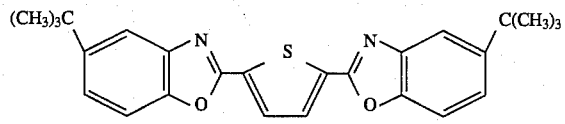

Compound (3):

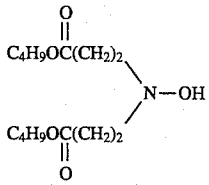

Mordant Agent:

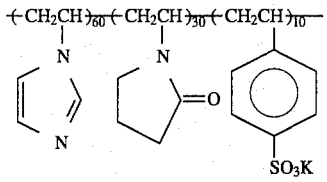

Hardening Agent (3):

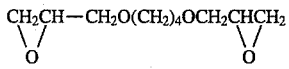

Water-Soluble Polymer (3):

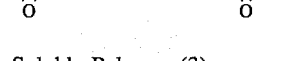

(M.W. 20,000)

Mat Agent:

Benzoguanamine Resin (mean grain size 15 μm)

Each of the above-mentioned photographic material samples Nos. 101 to 105 was combined with the above-mentioned image-receiving material sample R101 and processed with an image recording processor as described in Japanese Patent Application No. 63-137104 (corresponding to JP-A-2-84634).

Specifically, the photographic material sample was exposed with an original (test chart with wedges of yellow, magenta, cyan and gray each having a continuously varying color density) through a slit by scanning exposure at the temperature as indicated in Table 11, the exposed sample was dipped in water kept at 40° C. for 4 seconds, it was squeezed with rollers and then immediately attached to the image-receiving material sample in such a way that the coated top surfaces of the two faced each other, and the combined samples were heated with heat drum for 15 seconds in such a way that the surfaces of both elements which now had water applied thereto were heated up to 80° C. Then, the photographic material sample was peeled off from the image-receiving material sample, whereupon a sharp color image well corresponding to the original was formed on the image-receiving material sample.

The density of the image of the gray area thus obtained was measured with an automatic density recorder to obtain the magenta density. The results are shown in Table 11. The sensitivity was represented by the ratio of the reciprocal of the exposure amount giving a density of 0.7 to that of the comparative photographic material sample No. 101 (exposed at 25° C.) having a density of 100.

TABLE 11

| | Temperature for Exposure | | |
|---|---|---|---|
| Photographic Material Sample | 10° C. | 25° C. | 40° C. |
| 101 (comparative sample) | 70 | 100 | 125 |
| 102 (comparative sample) | 65 | 65 | 70 |
| 103 (sample of the invention) | 95 | 95 | 90 |
| 104 (sample of the invention) | 95 | 100 | 105 |
| 105 (sample of the invention) | 100 | 105 | 100 |

As is obvious from the results in Table 11, the photographic material samples of the present invention showed little fluctuation in sensitivity even though the temperature for exposure thereof varied.

EXAMPLE 2

Preparation of light-sensitive silver halide emulsions

Preparation of emulsion (1) (for fifth layer):

Solution (I) and solution (II) each having the composition shown in Table 13 below were simultaneously added to a well stirred aqueous solution having the composition shown in Table 12 over a period of 15 minutes. Next, solution (III) and solution (IV) each having the composition shown in Table 13 were added thereto over a period of 35 minutes.

TABLE 12

| Component | Amount |
|---|---|
| $H_2O$ | 630 cc |
| Gelatin | 20 g |
| KBr | 0.3 g |
| NaCl | 2 g |
| Compound-1(*) | 0.015 g |
| Temperature | 45° C. |

(*)Compound-1:

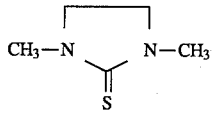

TABLE 13

| | I | II | III | IV |
|---|---|---|---|---|
| $AgNO_3$ (g) | 30 | — | 70 | — |
| KBr (g) | — | 21 | — | 28 |
| NaCl (g) | — | 6.9 | — | 3.5 |
| Water to make (cc) | 150 | 150 | 350 | 350 |

18 minutes after initiation of the addition of solution (III), 75 cc of a 0.5% methanol solution of sensitizing dye (a) was added to the system over a period of 25 minutes. After being rinsed with water and desalted (effected with precipitating agent (a) at a pH of 4.1), 22 g of gelatin was added to the system, which was adjusted to have a pH of 6.0 and a pAg of 7.9. The system was then subjected to chemical sensitization at 61° C. The compounds used for the chemical sensitization are shown in Table 14. The yield of the emulsion thus obtained, which was a monodisperse cubic emulsion having a fluctuation coefficient of 10.2%, was 630 g. The emulsion had a mean grain size of 0.31 μm.

Sensitizing Dye (a):

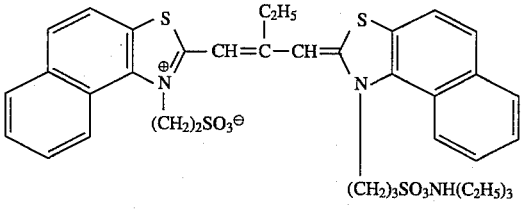

Precipitating Agent (a):

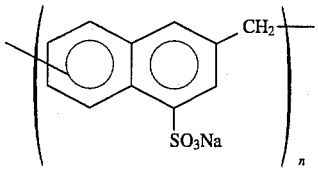

TABLE 14

| Chemical Sensitization | |
|---|---|
| Temperature | 61° C. |
| 4-Hydroxy-6-methyl-1,3,3a,7-tetrazaindene | 0.12 g |
| Sodium Thiosulfate | 6.0 mg |

Preparation of emulsion (2) (for third layer):

Solution (I) and solution (II) each having the composition shown in Table 16 were simultaneously added to a well stirred aqueous solution having the composition shown in Table 15 over a period of 10 minutes. Next, solution (III) and solution (IV) each having the composition shown in Table 16 were added thereto over a period of 45 minutes.

TABLE 15

| Component | Amount |
|---|---|
| $H_2O$ | 630 cc |
| Gelatin | 20 g |
| KBr | 0.5 g |
| NaCl | 2 g |
| Compound-1(*) | 0.015 g |
| Temperature | 50° C. |

Compound-1(*): Same as Compound 1 earlier identified in Table 12.

TABLE 16

| | I | II | III | IV |
|---|---|---|---|---|
| $AgNO_3$ (g) | 30 | — | 70 | — |
| KBr (g) | — | 21 | — | 28 |
| NaCl (g) | — | 6.9 | — | 3.5 |
| Water to make (cc) | 150 | 150 | 350 | 350 |

After being rinsed with water and desalted (effected with precipitating agent (a) at pH of 3.9), 12 g of gelatin was added to the system, which was adjusted to have a pH of 5.9 and a pAg of 7.8. The system was then subjected to chemical sensitization at 70° C. At the end of the chemical sensitization, 42 g of a gelatin dispersion of sensitizing dye (b) (gelatin 5%, sensitizing dye (b) 0.5%) was added to the system. The compounds used for the chemical sensitization are shown in Table 17. The yield of the emulsion thus obtained, which was a mono-disperse cubic emulsion having a fluctuation coefficient of 12.6%, was 645 g. The emulsion had a mean grain size of 0.32 μm.

Sensitizing Dye (b):

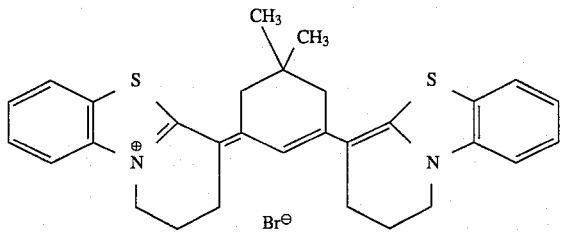

TABLE 17

| Chemical Sensitization | |
|---|---|
| Temperature | 70° C. |
| 4-Hydroxy-6-methyl-1,3,3a,7-tetrazaindene | 0.27 g |
| Triethylthiourea | 3 mg |

Preparation of emulsion (3) (for first layer):

Solution (I) and solution (II) each having the composition shown in Table 19 were simultaneously added to a well stirred aqueous solution having the composition shown in Table 18 over a period of 15 minutes. Next, solution (III) and solution (IV) each having the composition shown in Table 19 were added thereto over a period of 25 minutes.

TABLE 18

| Component | Amount |
|---|---|
| $H_2O$ | 630 cc |
| Gelatin | 20 g |
| KBr | 0.6 g |
| NaCl | 2 g |
| Compound-l(*) | 0.015 g |
| Temperature | 40° C. |

Compound-1(*): Same as Compound (1) earlier identified in Table 12.

TABLE 19

| | I | II | III | IV |
|---|---|---|---|---|
| $AgNO_3$ (g) | 30 | — | 70 | — |
| KBr (g) | — | 21 | — | 28 |
| NaCl (g) | — | 6.9 | — | 3.5 |
| Water to make (cc) | 150 | 150 | 250 | 350 |

After being rinsed with water and desalted (effected with precipitating agent (a) at pH of 3.8), 20 g of gelatin was added to the system, which was adjusted to have a pH of 6.6 and a pAg of 8.0. The system was then subjected to chemical sensitization at 58° C. At the end of the chemical sensitization, 42 g of a gelatin dispersion of sensitizing dye (c) (gelatin 5%, sensitizing dye (c) 1%) was added to the system. The compounds used for the chemical sensitization are shown in Table 20. The yield of the emulsion thus obtained, which was a mono-disperse cubic emulsion having a fluctuation coefficient of 9.7%, was 650 g. The emulsion had a mean grain size of 0.22 μm.

Sensitizing Dye (c):

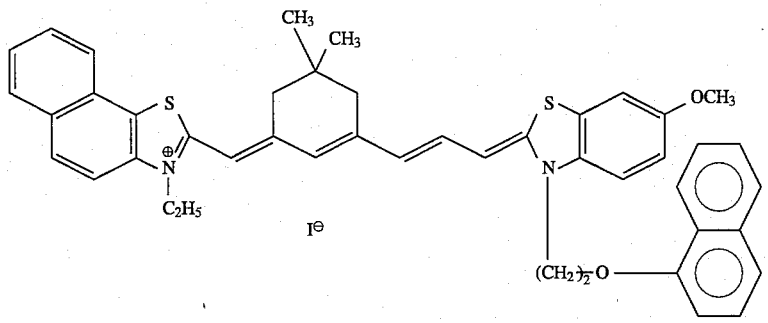

TABLE 20

| Chemical Sensitization | |
|---|---|
| Temperature | 58° C. |
| 4-Hydroxy-6-methyl-1,3,3a,7-tetrazaindene | 0.48 g |
| Triethylthiourea | 2.4 mg |
| Chloroauric Acid | 1.0 mg |

Preparation of gelatin dispersions of dye-donating compounds 14.64 g of magenta dye-donating compound (A), 0.8 g of reducing agent A, 0.20 g of antifoggant ①, 0.4 g of surfactant ③ and 5.1 g of high boiling point solvent (1) were weighed out. 70 ml of ethyl acetate was added thereto and all components dissolved under heat at about 60° C. to form a uniform solution. The solution was blended with 71 g of a 14% solution of lime-processed gelatin and 220 cc of water with stirring and then dispersed with a homogenizer for 10 minutes at 10,000 rpm. The dispersion is called a dispersion of a magenta dye-donating compound.

7.3 g of cyan dye-donating compound (B1), 10.6 g of cyan dye-donating compound (B2), 1.0 g of reducing agent A, 0.30 g of antifoggant ①, 0.4 g of surfactant ③ and 9.8 g of high boiling point solvent (1) were weighed out. 40 ml of ethyl acetate was added thereto and all components dissolved under heat at about 60° C. to form a uniform solution. The solution was blended with 71 g of a 14% solution of lime-processed gelatin and 260 cc of water with stirring and then dispersed with a homogenizer for 10 minutes at 10,000 rpm. The dispersion is called a dispersion of cyan dye-donating compounds.

18.8 g of yellow dye-donating compound (C), 1.0 g of reducing agent A, 0.13 g of antifoggant ①, 1.5 g of surfactant ③, 2.1 g of dye (a) and 7.5 g of high boiling point solvent (1) were weighed out. 45 ml of ethyl acetate was added thereto and all components dissolved under heat at about 60° C. to form a uniform solution. The solution was blended with 71 g of a 14% solution of lime-processed gelatin and 160 cc of water with stirring and then dispersed with a homogenizer for 10 minutes at 10,000 rpm. The dispersion is called a dispersion of an yellow dye-donating compound.

Using these dispersions, heat-developable photographic material sample No. 201 having the constitution shown in Table 21 was prepared. In the same manner, other heat-developable photographic material samples Nos. 202 to 205 as shown in Table 22 were prepared.

TABLE 21

Constitution of Photographic Material Sample 201

| Number of Layer | Name of Layer | Components | Amount Coated ($g/m^2$) |
|---|---|---|---|
| 7th Layer | Protective Layer | Gelatin | 0.264 |
| | | Mat Agent | 0.018 |
| | | Zinc Hydroxide | 0.964 |
| | | Surfactant ① | 0.028 |
| | | Surfactant ② | 0.011 |
| | | Water-soluble Polymer (1) | 0.004 |
| 6th Layer | Interlayer | Gelatin | 0.762 |
| | | Surfactant ① | 0.007 |
| | | Surfactant ② | 0.022 |
| | | Water-soluble Polymer (1) | 0.016 |
| 5th Layer | Red (670 nm)-sensitive Layer | Emulsion (1) | 0.205 (as Ag) |
| | | Magenta Dye-donating Substance (A) | 0.2845 |
| | | High Boiling Point Solvent (1) | 0.100 |
| | | Reducing Agent A | 0.016 |
| | | Antifoggant ① | 0.004 |
| | | Surfactant ③ | 0.007 |
| | | Gelatin | 0.297 |
| | | Antifoggant ③ | 0.0004 |
| | | Water-soluble Polymer (1) | 0.007 |
| 4th Layer | Interlayer | Hardening Agent | 0.058 |
| | | Gelatin | 0.629 |
| | | Surfactant ① | 0.009 |
| | | Surfactant ④ | 0.046 |
| | | Water-soluble Polymer (1) | 0.012 |
| 3rd Layer | Near-infrared (750 nm)-sensitive Layer | Emulsion (2) | 0.211 (as Ag) |
| | | Cyan Dye-donating Substance (B1) | 0.132 |
| | | Cyan Dye-donating Substance (B2) | 0.1983 |
| | | High Boiling Point Solvent (1) | 0.178 |
| | | Reducing Agent A | 0.018 |
| | | Antifoggant ① | 0.005 |
| | | Surfactant ③ | 0.007 |
| | | Gelatin | 0.284 |
| | | Antifoggant ② | 0.0003 |
| | | Stabilizer | 0.0043 |
| | | Water-soluble Polymer (1) | 0.010 |
| 2nd Layer | Interlayer | Gelatin | 0.629 |
| | | Surfactant ① | 0.006 |
| | | Surfactant ④ | 0.057 |
| | | Water-soluble Polymer (1) | 0.009 |
| 1st Layer | Infrared (810 nm)-sensitive Layer | Emulsion (3) | 0.215 (as Ag) |
| | | Antifoggant ② | $8.4 \times 10^{-4}$ |
| | | Yellow Dye-donating Substance (C) | 0.429 |
| | | Dye (a) | 0.049 |
| | | High Boiling Point Solvent (1) | 0.172 |
| | | Reducing Agent A | 0.023 |
| | | Antifoggant ① | 0.003 |
| | | Surfactant ③ | 0.034 |
| | | Gelatin | 0.338 |
| | | Stabilizer | 0.0054 |
| | | Water-soluble Polymer (1) | 0.014 |
| Support | | Polyethylene-laminated Neutral Paper (thickness 120 μm) | |

TABLE 22

| Photographic Material Sample | Light-Sensitive Silver Halide | Amount of Iron (II) Ion Added to Solution IV (mol/mol of Ag) |
|---|---|---|
| 201 (comparative sample) | (2) | None |
| | (3) | None |
| 202 (comparative sample) | (2)-1 | $5.0 \times 10^{-3}$ |
| | (3)-1 | $4.0 \times 10^{-3}$ |
| 203 (sample of the invention) | (2)-2 | $1.0 \times 10^{-4}$ |
| | (3)-2 | $8.0 \times 10^{-5}$ |
| 204 (sample of the invention) | (2)-3 | $2.0 \times 10^{-5}$ |
| | (3)-3 | $1.6 \times 10^{-5}$ |
| 205 (sample of the invention) | (2)-4 | $4.0 \times 10^{-6}$ |
| | (3)-4 | $3.2 \times 10^{-6}$ |

Magenta Dye-Donating Substance (A):

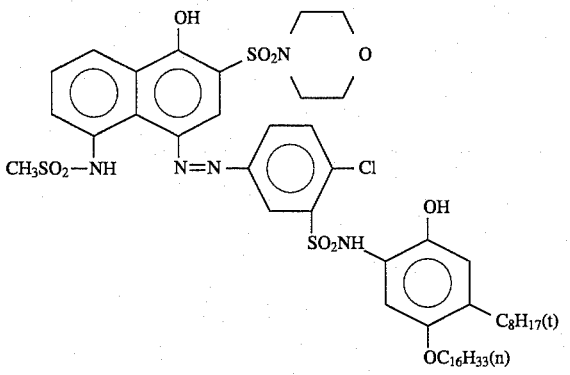

Cyan Dye-Donating Substance (B1):

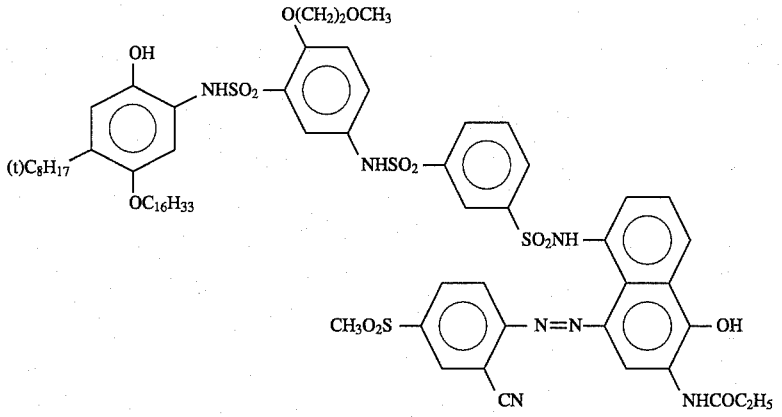

Cyan Dye-Donating Substance (B2):
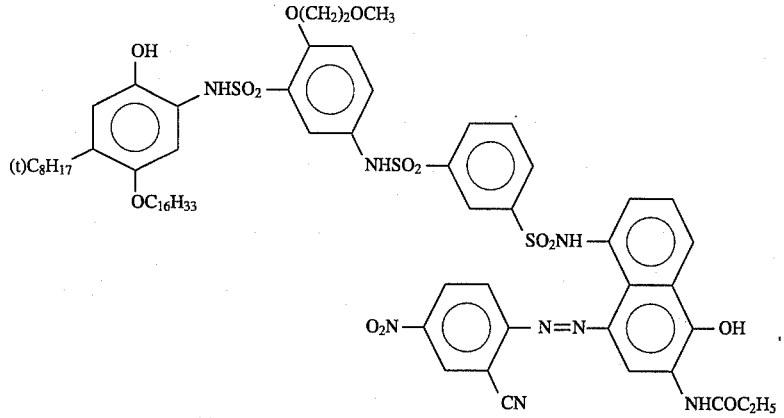
Yellow Dye-Donating Substance (C):
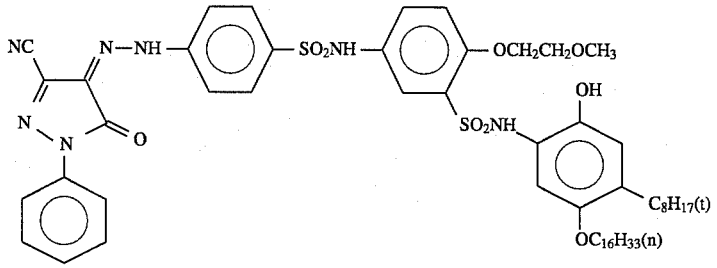
Reducing Agent (A):
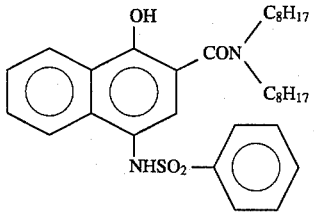
Antifoggant ①:
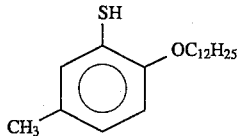
Antifoggant ②:
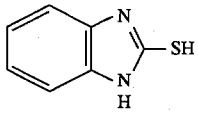
Antifoggant ③:
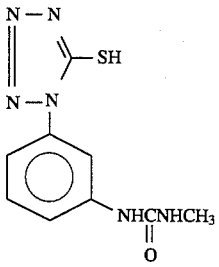
Surfactant ①:
Aerosol OT
Surfactant ②:
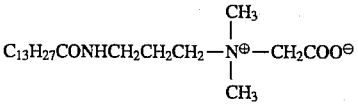
Surfactant ③:
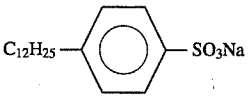

Surfactant ④:

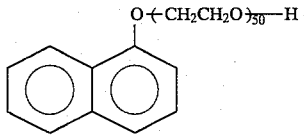

Hardening Agent:

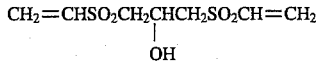

Stabilizer:

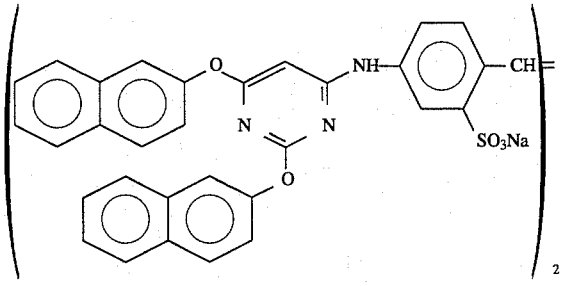

Dye (a):

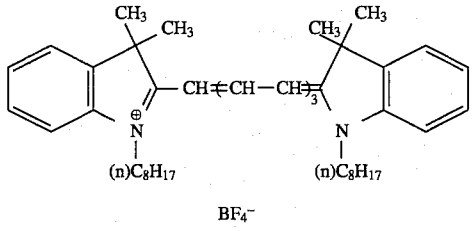

Water-Soluble polymer (1):

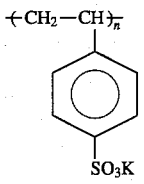

High boiling point organic solvent (1) was triisononyl phosphate, and high boiling point organic solvent (2) was trihexyl phosphate.

Preparation of a dispersion of zinc hydroxide 12.5 g of zinc hydroxide having a mean grain size of 0.15 μm, 1 g of carboxymethyl cellulose as a dispersing agent, and 0.1 g of sodium polyacrylate were added to 100 ml of a 4% gelatin solution and ground in a mill with glass beads having a mean grain size of 0.75 mm. The glass beads were separated to obtain a dispersion of zinc hydroxide.

Photographic material samples Nos. 202 to 205 were prepared in the same manner as in the preparation of photographic material sample No. 201, except that potassium hexacyanoferrate(II) trihydrate in the amount as shown in Table 22 was added to solution (IV) for preparing light-sensitive silver halides (2) and (3). Preparation of a dye-fixing material sample The layers each having the composition given in Table 23 were formed on a polyethylene-laminated paper support to obtain a dye-fixing material sample.

TABLE 23

| Layer | Components | Amount Coated ($mg/m^2$) |
|---|---|---|
| 3rd Layer | Gelatin | 0.05 |
| | Silicone Oil(*1) | 0.04 |
| | Surfactant(*2) | 0.001 |
| | Surfactant(*3) | 0.02 |
| | Surfactant(*4) | 0.10 |
| | Guanidine Picolinate | 0.45 |
| | Polymer(*5) | 0.24 |
| 2nd Layer | Mordant Agent(*6) | 2.35 |
| | Polymer(*7) | 0.60 |
| | Gelatin | 1.40 |
| | Polymer(*5) | 0.21 |
| | High Boiling Point Solvent(*8) | 1.40 |
| | Guanidine Picolinate | 1.80 |
| | Surfactant(*2) | 0.02 |
| 1st Layer | Gelatin | 0.45 |
| | Surfactant(*4) | 0.01 |
| | Polymer(*5) | 0.04 |
| | Hardening Agent(*9) | 0.30 |
| Support | Polyethylene-Laminated Paper Support (thickness 170μ) | |
| 1st Backing Layer | Gelatin | 3.25 g |
| | Hardening Agent(*9) | 0.25 |
| 2nd Backing Layer | Gelatin | 0.44 |
| | SIlicone Oil(*1) | 0.08 |
| | Surfactant(*2) | 0.002 |
| | Mat Agent(*10) | 0.09 |
| | Surfactant(*11) | 0.01 |

The compounds used in Table 23 are identified below.

Silicone Oil(*1):

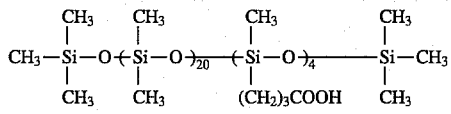

Surfactant(*2):

Aerosol OT

Surfactant(*3):

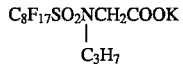

Surfactant(*4):

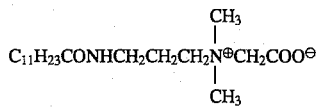

Surfactant(*11):

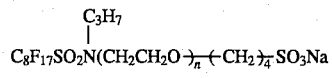

(n: about 4)

Mordant Agent(*6):

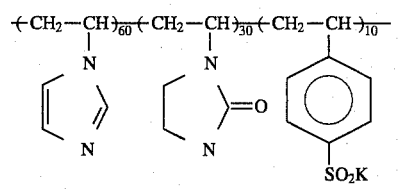

Hardening Agent (*9):

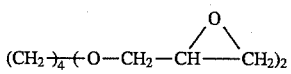

The polymers, high boiling point organic solvent and mat agent used are identified below.

Polymer(*5):

Vinyl alcohol-sodium acrylate copolymer (75/25, molar ratio)

Polymer(*7):

Dextran (molecular weight 70,000)

High Boiling Point Organic Solvent(*8):

Reofos 95 (produced by Ajinomoto Co.)

Mat Agent(*10):

Benzoanamine Resin (amount of grains of a size of more than 10 μm: 18 vol. %; balance of a size less than 10μ)

The samples prepared above were exposed and then processed to evaluate the same.

Briefly, each sample was exposed to a tungsten lamp of 500 lux through an R-IR1-IR2 three-color separation filter having a continuously varying density (where R is a band-pass filter of from 650 to 690 nm; IR1 is a band-pass filter of from 730 to 770 nm; and IR2 is a filter of 790 nm or more), for one second at the temperature as indicated in Table 25.

In a second set of runs, each sample was exposed with a laser exposure device as described in JP-A-2-129625, under the conditions as given in Table 24 and at the temperature as given in Table 25. 11 ml/m$^2$ of water was applied to each of the exposed samples Nos. 201 to 205 with a wire bar. Each exposed sample was then attached to the above-mentioned dye-fixing material sample in such a way that the coated surfaces thereof faced each other. The combined samples were then heated with heated rollers in such a way that the surfaces which both then had water applied thereto could be heated up to 85° C., for 25 seconds, and thereafter the photographic material sample was peeled off from the dye-fixing material sample. Thus, an image was formed on the dye-fixing material sample.

TABLE 24

| | |
|---|---|
| Beam Intensity on the Surface of Photographic Material Sample | 1 mV |
| Scanning Density | 800 dpi (32 luster per mm) |
| Beam Diameter | 100 ± 10 μm in the main scanning direction<br>80 ± 10 μm in the side-scanning direction |
| Exposure Time | 0.9 msec per luster |
| Wavelength for Exposure | 670, 750, 810 nm (laser rays) |
| Exposure Amount | 1 log E variation (maximum 80 erg/cm$^2$, minimum 1.2 erg/cm$^2$) per 2.5 cm in the side-scanning direction |
| Variation of Exposure Amount | Emitting Time Modulated |

The density of the image thus obtained was measured with an automatic density recorder to obtain the magenta density thereof. The results are shown in Table 25. The sensitivity was represented by the ratio of the reciprocal of the exposure amount giving a density of 0.7 to that of the comparative photographic material sample No. 201 (exposed at 25° C. for one second) having a density of 100.

TABLE 25

| Photographic Material | Temperature for Exposure | | | | | |
|---|---|---|---|---|---|---|
| | One Second Exposure | | | Laser Exposure | | |
| Sample | 10° C. | 25° C. | 40° C. | 10° C. | 25° C. | 40° C. |
| 201 (comparative sample) | 40 | 100 | 145 | 10 | 35 | 60 |
| 202 (comparative sample) | 50 | 55 | 60 | 65 | 100 | 135 |
| 203 (sample of the invention) | 90 | 95 | 100 | 85 | 90 | 90 |
| 204 (sample of the invention) | 95 | 95 | 95 | 90 | 100 | 100 |
| 205 (sample of the invention) | 95 | 100 | 100 | 100 | 105 | 105 |

As is obvious from the results in Table 25 above, the photographic material samples of the present invention involved little fluctuation in sensitivity even though the temperature for exposure thereof varied. In addition, it can also be seen from the results that the sensitivity of the photographic material samples of the present invention does not lower even if they are exposed at high intensity with laser rays for a short period of time and that the fluctuation in sensitivity thereof is slight, even though the temperature for exposure with the laser rays varies.

EXAMPLE 3

Preparation of emulsion (4) and emulsion (5) (for third layer)

Solution (IV) in Table 16 was varied as indicated in Table 26, and 18 cc of a methanol solution containing 0.12 g of sensitizing dye (x) and 0.06 g of sensitizing dye (y) (also containing 0.1 N paratoluenesulfonic acid) and 0.11 g of potassium iodide were added to the emulsion at 70° C. at the end of the chemical sensitization thereof, whereby the recited components were adsorbed onto the silver halide grains over a period of 60 minutes.

Photographic material samples Nos. 301 and 302 were prepared in the same manner as in the preparation of sample No. 201, except that emulsion (4) and emulsion (5), respectively, were used in place of emulsion (2). These samples Nos. 301 and 302 were subjected to the same testing as in Example 2 and the results shown in Table 27 were obtained. From the results, it can be understood that the photographic material sample of the present invention still showed the same effects, even though an emulsion containing Ir was used.

Sensitizing Dye (x):

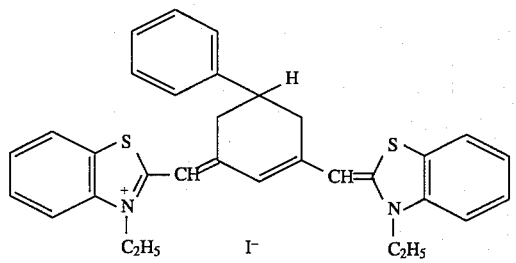

Sensitizing Dye (y):

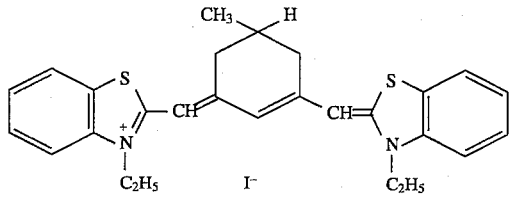

TABLE 26

| Photographic Material Sample | Light Sensitive Silver Halide | Composition of Solution (IV) | |
|---|---|---|---|
| 301 (comparative sample) | (4) | Kbr | 28 g |
| | | NaCl | 3.5 g |
| | | $K_2IrCl_6$ | $3.87 \times 10^{-5}$ g |
| 302 (sample of the invention) | (5) | KBr | 28 g |
| | | NaCl | 3.5 g |
| | | $K_2IrCl_6$ | $3.87 \times 10^{-5}$ g |
| | | $K_4[Fe(CN)_6]$ | 0.016 g |

TABLE 27

| Photographic Material | Temperature for Exposure (one second exposure) | | | Temperature for Exposure (laser exposure) | | |
|---|---|---|---|---|---|---|
| Sample | 10° C. | 25° C. | 35° C. | 10° C. | 25° C. | 35° C. |
| 301 (comparative sample) | 35 | 100 | 160 | 25 | 85 | 95 |
| 302 (sample of the invention) | 110 | 120 | 125 | 100 | 110 | 115 |

While the invention has been described in detail and with reference to specific embodiments thereof, it will be apparent to one skilled in the art that various changes and modifications can be made therein without departing from the spirit and scope thereof.

What is claimed is:

1. A heat-developable photographic material comprising on a support a light-sensitive silver halide emulsion, a reducing agent, a binder and a dye-donating compound, in which at least one light-sensitive silver halide emulsion on the support comprises cubic silver chlorobromide grains having a silver bromide content of at least about 90 mol % and containing from $1\times10^{-7}$ to $1\times10^{-3}$ mol of iron ions per mol of silver halide.

2. The heat-developable photographic material as claimed in claim 1, wherein the at least one light-sensitive silver halide emulsion comprising iron ions in the cubic silver chlorobromide grains has a maximum spectral sensitivity wavelength in the range of 700 nm or more.

3. The heat-developable photographic material as claimed in claim 1, wherein the cubic silver chlorobromide grains in the at least one light-sensitive silver halide emulsion comprising the iron ions in the grains are formed in the presence of the iron ions.

4. The heat-developable photographic material as claimed in claim 1, wherein the cubic silver chlorobromide grains in the at least one light-sensitive silver halide emulsion comprising the iron ions in the grains are formed in the presence of an iron complex.

5. The heat-developable photographic material as claimed in claim 4, wherein the iron complex is selected from the group consisting of hexacyanoferrates(II), hexacyanoferrates(III), ferrous thiocyanates and ferric thiocyanates.

6. The heat-developable photographic material as claimed in claim 1, wherein the at least one light-sensitive silver halide emulsion on the support comprises cubic silver chlorobromide grains containing from $1\times10^{-6}$ to $5\times10^{-4}$ mol of iron ions per mol of silver halide.

7. The heat-developable photographic material as claimed in claim 1, wherein the cubic silver chlorobromide grains comprise at least one of iridium ions and rhodium ions in combination with iron ions.

8. The heat-developable photographic material as claimed in claim 1, wherein the material comprises at least three silver halide emulsion layers each having light-sensitivity in a different spectral region.

9. The heat-developable photographic material as claimed in claim 1, wherein the at least one light-sensitive silver halide emulsion on the support comprises from 1 mg to 10 g on a silver basis of a light-sensitive silver halide, per square meter of the support.

* * * * *